US012259138B1

(12) United States Patent
Maghsadi et al.

(10) Patent No.: US 12,259,138 B1
(45) Date of Patent: Mar. 25, 2025

(54) COLLAPSIBLE STAND FOR A FIREPIT

(71) Applicant: Solo Brands, LLC, Grapevine, TX (US)

(72) Inventors: Alexander K. Maghsadi, Fort Worth, TX (US); John L. Zivich, Dallas, TX (US); Josiah A. Wilhelm, Fort Worth, TX (US)

(73) Assignee: Solo Brands, LLC, Grapevine, TX (US)

( * ) Notice: Subject to any disclaimer, the term of this patent is extended or adjusted under 35 U.S.C. 154(b) by 0 days.

(21) Appl. No.: 18/815,643

(22) Filed: Aug. 26, 2024

(51) Int. Cl.

| | |
|---|---|
| ***F24B 1/18*** | (2006.01) |
| ***F24B 1/181*** | (2006.01) |
| ***F24B 1/182*** | (2006.01) |
| *F24B 1/193* | (2006.01) |
| *F24B 1/195* | (2006.01) |

(52) U.S. Cl.
CPC ..... *F24B 1/181* (2013.01); *F24B 1/182* (2013.01); *F24B 1/193* (2013.01); *F24B 1/195* (2013.01)

(58) Field of Classification Search
CPC ..... F24B 1/181; F24B 1/182; F24B 1/193; F24B 1/195
See application file for complete search history.

(56) References Cited

U.S. PATENT DOCUMENTS

| | | | | |
|---|---|---|---|---|
| 4,726,350 | A * | 2/1988 | Steinhauser | F24C 3/12 126/38 |
| 2011/0073723 | A1* | 3/2011 | Ashpole | A47C 4/20 248/176.2 |
| 2014/0290640 | A1* | 10/2014 | Kim | A47J 36/26 126/38 |
| 2020/0022486 | A1* | 1/2020 | Paesang | A47J 37/0763 |
| 2021/0212509 | A1* | 7/2021 | Medina Cantu | A47J 37/0763 |
| 2021/0282592 | A1* | 9/2021 | Jan | A47J 37/079 |
| 2023/0025185 | A1* | 1/2023 | Winter | F24C 3/14 |
| 2024/0023754 | A1* | 1/2024 | Zhang | F24B 1/182 |

* cited by examiner

*Primary Examiner* — Alfred Basichas
(74) *Attorney, Agent, or Firm* — Haynes and Boone, LLP

(57) ABSTRACT

A stand for a firepit includes a number of uprights spaced apart to receive a firepit, a horizontal support fixedly attached to the uprights and configured to be adjacent to the firepit when the fire pit is received between the uprights, a number of leg uprights extending from the uprights, a number of cross members extending from the leg uprights and toward a central hub, and a number of legs selectively connectable to the leg uprights.

24 Claims, 26 Drawing Sheets

COLLAPSIBLE STAND FOR A FIREPIT

TECHNICAL FIELD

The subject matter described herein relates to a stand for a firepit that provides elevational adjustment as desired.

BACKGROUND

Portable firepits can be used to burn combustible fuel (e.g., wood, paper, etc.) to produce light, heat, and ambience in back yards, campsites, and other settings. However, fire pits, like camp fires, are typically on or near the ground. This might not be ideal when a person would like to cook over the fire pit in a barbeque setting or a social setting, such as a tailgating event, where the chef would prefer to stand upright. Accordingly, a need exists for improved firepits that address the forgoing and other concerns.

The information included in this Background section of the specification, including any references cited herein and any description or discussion thereof, is included for technical reference purposes only and is not to be regarded as subject matter by which the scope of the disclosure is to be bound.

SUMMARY

Disclosed is an example collapsible firepit stand. In the example disclosed herein, the collapsible firepit stand includes two folding shelves, as well as four folding firepit supports, four shelf uprights, and two panels, all configured to hold the firepit in position on the stand. The collapsible firepit stand also includes four collapsible legs that terminate in heat-insulating silicone feet. The collapsible firepit stand increases the variety of locations and settings where the firepit can be used. The collapsible firepit stand can also be used in a collapsed configuration, with the legs folded under. Furthermore, with the folding firepit supports folded upward, the collapsible firepit stand can be collapsed into a minimum-volume storage configuration.

One general aspect includes a stand for a firepit. The stand includes a plurality of uprights spaced apart to receive a firepit therebetween. The stand also includes a horizontal support fixedly attached to the plurality of uprights and configured to be adjacent the firepit when the fire pit is received between the plurality of uprights. The stand also includes a plurality of leg uprights extending from the plurality of uprights. The stand also includes a plurality of cross members extending from the plurality of leg uprights and toward a central hub. The stand also includes a plurality of legs selectively connectable to the plurality of leg uprights.

Implementations may include one or more of the following features. In some embodiments, the stand may include a plurality of foldable shelves lockable in a horizontal configuration and selectively transitionable into a vertical configuration. In some embodiments, the stand may include a plurality of foldable firepit supports attached to the plurality of leg uprights above the cross members, and configured to: allow the firepit to rest on the cross members when oriented in a substantially vertical direction; and allow the firepit to rest on the plurality of foldable firepit supports above the cross members when oriented in a horizontal direction. In some embodiments, the plurality of legs are removable from the plurality of leg uprights and selectively positionable, via a plurality of cross member feet, in a folded, substantially horizontal position parallel to the plurality of cross members. In some embodiments, the plurality of leg uprights are retained against the plurality of cross members via a plurality of retention features fitted into a plurality of grooves within the plurality of cross member feet. In some embodiments, the plurality of retention features may include a plurality of elastic cords. In some embodiments, the stand may include a foldable shelf and a plurality of utensil hooks positioned on the foldable shelf. In some embodiments, the stand is positionable on ground, and where the shelf is sized such that when the shelf is folded in a vertical position and the plurality of legs are folded in a horizontal position, the shelf and utensil hooks do not touch the ground.

One general aspect includes a stand for a firepit. The stand includes four shelf uprights. The stand also includes two foldable shelves, each supported by two of the four shelf uprights. The stand also includes two curved horizontal supports configured to at least partially surround the firepit, where each curved horizontal support is fixedly attached to two of the four shelf uprights. The stand also includes four leg uprights, where each leg upright is fixedly attached to a shelf upright of the four shelf uprights. The stand also includes a central hub. The stand also includes four cross members, each fixedly attached to one leg upright of the four leg uprights and to the central hub. The stand also includes four legs, where each leg is selectively connectable to one leg upright of the four leg uprights.

Implementations may include one or more of the following features. In some embodiments, each leg is securable in a horizontal configuration and selectively transitionable into a vertical configuration. In some embodiments, the stand may include four foldable firepit supports, each fixedly attached to one leg upright of the four uprights, above the cross members, and configured to: when oriented in a substantially vertical direction, allow the firepit to rest on the cross members; and when oriented in a horizontal direction, allow the firepit to rest on the foldable firepit supports above the cross members. In some embodiments, the legs are removable from the leg uprights and reversibly positionable, via four cross member feet, in a folded, substantially horizontal position parallel to and in contact with the four cross members, where each cross member includes one cross member foot of the four cross member feet. In some embodiments, the leg uprights are retained against the cross members by nesting features, where each nesting feature nests into a groove of a cross member foot. In some embodiments, the leg uprights are retained against the cross members via bungie cords, where each bungie cord is connected to one leg and one leg upright. In some embodiments, each shelf may include a utensil hook. In some embodiments, the stand is positionable on ground, and dimensions of the shelves are such that when the shelves are folded in a vertical position and the legs are folded in a horizontal position, the shelves and utensil hooks do not touch the ground.

One general aspect includes a firepit stand. The firepit stand includes a plurality of leg uprights. The stand also includes a plurality of legs movable from a first configuration supporting the leg uprights to a second storage configuration. The stand also includes a plurality of foldable firepit supports on the leg uprights configured to selectively support a fire pit. Other embodiments of this aspect include corresponding computer systems, apparatus, and computer programs recorded on one or more computer storage devices, each configured to perform the actions of the methods.

Implementations may include one or more of the following features. In some embodiments, when the plurality of foldable legs are in a deployed, substantially vertical position and the plurality of foldable firepit supports are in a deployed, substantially horizontal position, the firepit is supported within the firepit stand at a first height; and when the plurality of foldable legs are in a deployed, substantially vertical position and the plurality of foldable firepit supports are in a folded, substantially vertical position, the firepit is supported within the firepit stand at a second height less than the first height; and when the plurality of foldable legs are in a folded, substantially horizontal position and the plurality of foldable firepit supports are in a folded, substantially vertical position, the firepit is supported within the firepit stand at a third height less than the second height. In some embodiments, the foldable shelf is transitionable between a horizontal configuration and a non-horizontal configuration, and the foldable shelf is lockable in the horizontal configuration. In some embodiments, at least three feet of the plurality of feet are in contact with ground when the plurality of foldable legs are in a deployed, substantially vertical position, and a different at least three feet of the plurality of feet are in contact with the ground when the plurality of foldable legs are in a folded, substantially horizontal position.

One general aspect includes a firepit stand. The firepit stand includes a rigid frame that may include: a plurality of upright legs spaced apart to receive a firepit therebetween; and a plurality of cross members connecting the plurality of upright legs, the plurality of cross members extending radially inward from the plurality of upright legs to a central hub. The stand also includes a plurality legs vertically and matingly attachable to the rigid frame in a first standing configuration, and horizontally and matingly attachable to the rigid frame in a second collapsed configuration.

Implementations may include one or more of the following features. In some embodiments, the firepit stand may include firepit supports supported by the upright legs, the firepit supports being movable between an upward configuration that permits passage of a firepit and a downward configuration that supports the firepit. In some embodiments, the firepit stand may include a shelf supported by at least two of the plurality of upright legs, the shelf being pivotable between a horizontal position and a vertical position. In some embodiments, the firepit stand may include: a curved brace attached to at least two upright legs of the plurality of upright legs; and a fabric panel attached to the curved brace.

The collapsible firepit stand disclosed herein has particular, but not exclusive, utility for supporting and adjusting a height of the fire pit. This may aid in, among other things, grilling foods in back yard, tailgate party, and campsite settings.

This Summary is provided to introduce a selection of concepts in a simplified form that are further described below in the Detailed Description. This Summary is not intended to identify key features or essential features of the claimed subject matter, nor is it intended to limit the scope of the claimed subject matter. A more extensive presentation of features, details, utilities, and advantages of the collapsible firepit stand, as defined in the claims, is provided in the following written description of various embodiments of the disclosure and illustrated in the accompanying drawings.

BRIEF DESCRIPTION OF THE DRAWINGS

Illustrative embodiments of the present disclosure will be described with reference to the accompanying drawings, of which.

DETAILED DESCRIPTION

Figure 1:
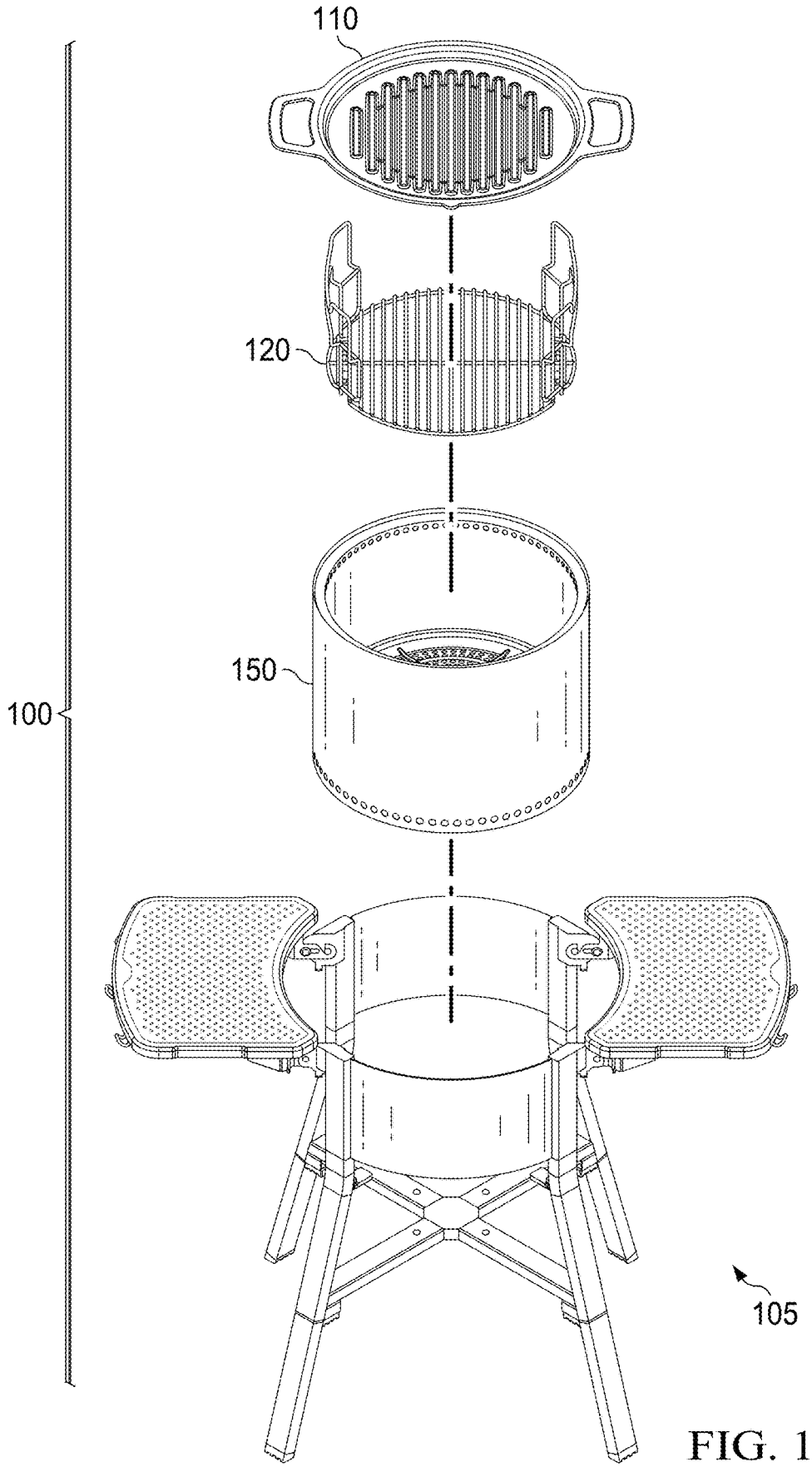
FIG. 1 is an elevated front perspective, partially exploded view of an example firepit system, in accordance with at least one embodiment of the present disclosure.

The present disclosure is directed to an example collapsible firepit stand that may enable the firepit to be used on surfaces that might burn, scorch, melt, degrade, or discolor if they came in direct contact with the firepit. The legs also raise the height of the firepit, thus making it more useful for grilling of foods by a standing cook. Thus, the collapsible firepit stand greatly increases the variety of locations and settings where the firepit can be used, including but not limited to lawns, patios, decks, tabletops, forest floors, truck beds and tailgates, etc.

Notably, the collapsible firepit stand can also be used in a partially collapsed configuration, with the legs folded under, as discussed herein, which may make it more suitable for grilling of foods by a seated cook. Furthermore, with the folding firepit supports folded upward, the collapsible firepit stand can be collapsed into a minimum-volume configuration for shipping, transport to or from the site of use, storage, etc.

The present disclosure aids in the placement of firepits, by improving their ability to be placed on heat-damageable surfaces without damage to those surfaces. Implemented on as an articulated arrangement of metal legs and uprights, the collapsible firepit stand disclosed herein provides practical, physical support for the firepit. This improved standoff capability transforms a firepit with potentially hot outer surfaces into a structure that can safely be placed on flammable or heat damageable surfaces, without the normally routine need to place an insulating material such as brick or tile in between. This unconventional approach improves the functioning of the firepit, by increasing the variety of environments in which it can safely be used.

These descriptions are provided for exemplary purposes only, and should not be considered to limit the scope of the collapsible firepit stand. Certain features may be added, removed, or modified without departing from the spirit of the claimed subject matter.

For the purposes of promoting an understanding of the principles of the present disclosure, reference will now be made to the embodiments illustrated in the drawings, and specific language will be used to describe the same. It is nevertheless understood that no limitation to the scope of the disclosure is intended. Any alterations and further modifications to the described devices, systems, and methods, and any further application of the principles of the present disclosure are fully contemplated and included within the present disclosure as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately.

FIG. 1 is a front top perspective, partially exploded view of an example firepit system 105, in accordance with at least one embodiment of the present disclosure. The firepit system 105 includes a collapsible firepit stand 100, a firepit 150, a grilling pan 110, and a drop-in charcoal adapter 120. The drop-in charcoal adapter is described for example in U.S. application Ser. No. 18/815,533, filed on 26 Aug. 2024, incorporated by reference as though fully set forth herein. The firepit 150 is described for example in U.S. Pat. No. 11,879,641, filed 5 Feb. 2021, incorporated by reference as though fully set forth herein. The grilling pan 110, drop-in charcoal adapter 120, and firepit 150 may be made of any suitable material, including but not limited to stainless steel. The collapsible firepit stand 100 is described herein.

Figure 2:
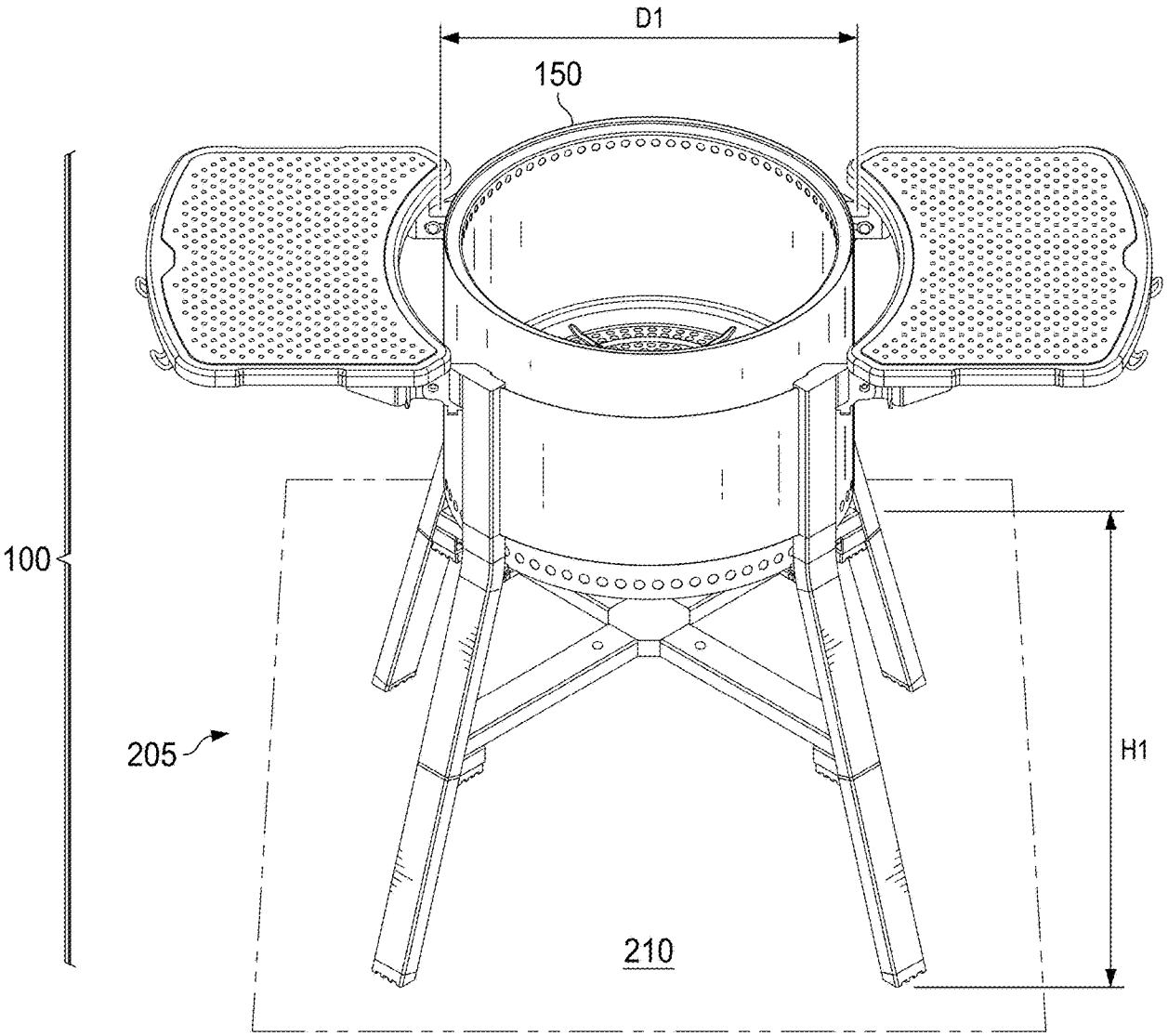
FIG. 2 is an elevated front perspective view of an example firepit system, in accordance with at least one embodiment of the present disclosure.

FIG. 2 is a top front perspective view of an example firepit system 205, in accordance with at least one embodiment of the present disclosure. The example firepit system 205 includes the collapsible firepit stand 100 and the firepit 150. The firepit 150 fits within the collapsible firepit stand 100 as described below. The collapsible firepit stand raises the firepit 150 to a height H1 where (1) it may be suitable for grilling or other cooking by a standing cook, and (2) the hot outer surfaces of the firepit 150 will not damage a surface 210 on which the collapsible firepit stand 100 is resting. The firepit 150 has an outer diameter D1, which fits within the collapsible firepit stand 100.

Figure 3:
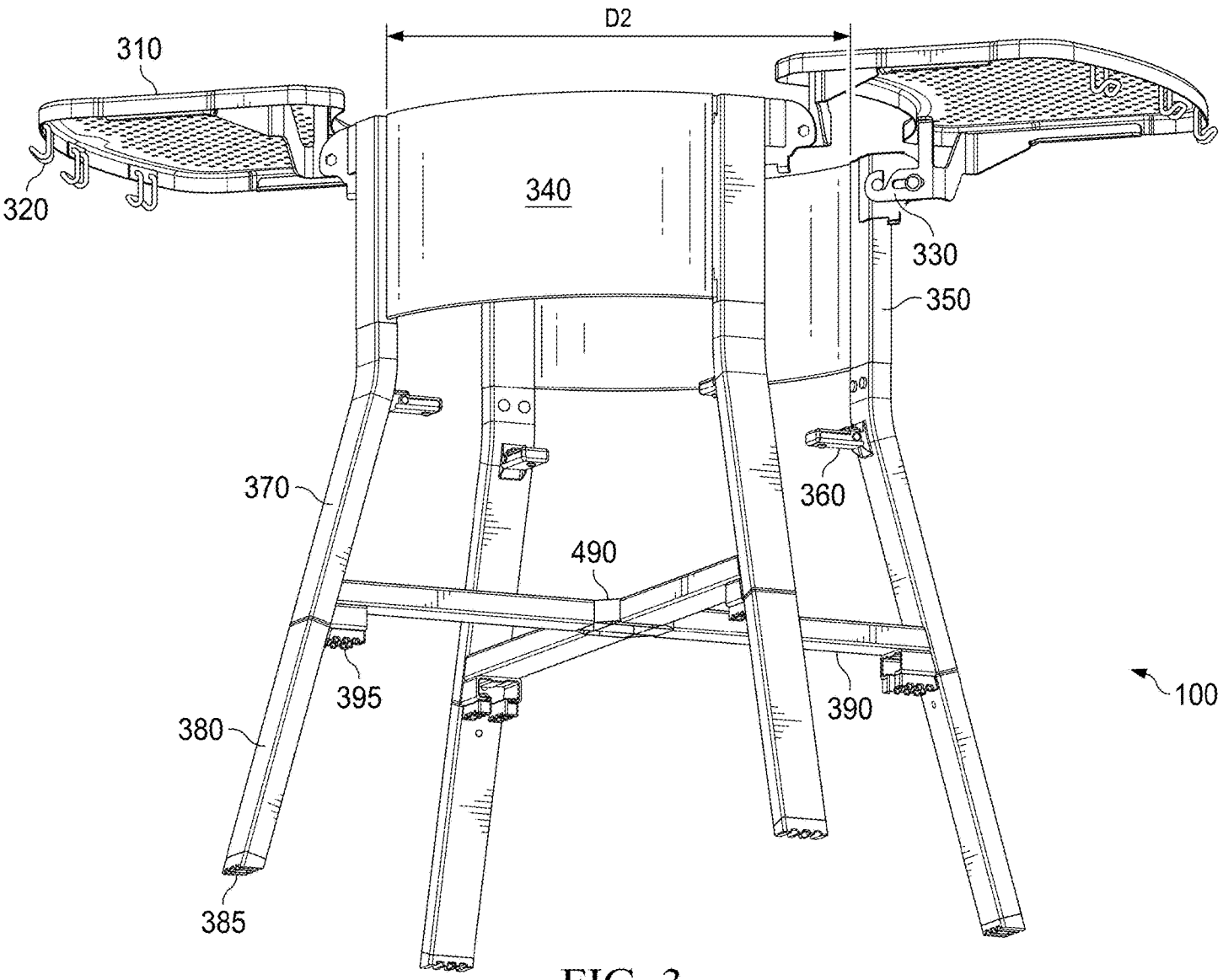
FIG. 3 is a bottom front perspective view of an example collapsible firepit stand, in accordance with at least one embodiment of the present disclosure.

FIG. 3 is a bottom front perspective view of an example collapsible firepit stand 100, in accordance with at least one embodiment of the present disclosure. In the example shown in FIG. 3, the collapsible firepit stand 100 includes two foldable shelves 310, each supporting three utensil hooks 320, and each foldable via two hinge assemblies 330. The collapsible firepit stand 100 also includes two curved horizontal support bars, that in the example shown, are shown as panels 340. These horizontal support bars (shows as panels 340 in FIG. 3) at least partially surround the firepit, and thus serve any of a variety of functions. Three example functions may include: (1) to serve as heat shields between the user(s) and the hot outer surfaces of the firepit, (2) to provide a stabilizing structural connection between the shelf uprights 350, and (3) to protect the firepit from dents, scratches, etc. In some examples, the horizontal support bars are not panels, but are horizontal bars or beams that extend between and connect some adjacent shelf uprights. The collapsible firepit stand 100 also includes four leg uprights 370 that connect the shelf uprights 350 to the legs 380, and that also serve as retention features for the firepit. Projecting from the leg uprights 370 are four foldable firepit supports 360, which can be folded down to support the firepit, or folded up for storage, as described below. The collapsible firepit stand 100 also includes four legs 380, each terminating in feet 385. The feet 385 may be of any material, but in some implementations are made of a soft, tractile, insulative material such as silicone. Projecting from the leg uprights 370 are four cross members 390 that provide structural rigidity between the leg uprights 370.

The shelf uprights 350 may be fixedly attached to, or may be continuous with, the leg uprights 370. The legs 380 may be reversibly attached to the leg uprights 370 as described herein. The cross members 390 may be fixedly attached to the leg uprights 370, and to a central hub 490. The curved panels 340 may be fixedly attached to the shelf uprights 350. The curved panels 340 may be arcs that together define a width or form a diameter D2, which is greater than the diameter D1 (shown in FIG. 2) of the firepit, such that the firepit can fit within the collapsible firepit stand 100. It is understood that other numbers of shelves, panels, uprights, legs, and foldable firepit supports may be used than are shown in FIG. 3, including both larger and smaller numbers than shown.

The shelves 310, utensil hooks 320, legs 380, leg uprights 370, shelf uprights 350, and hinge mechanism 330 may be made of any suitable material, including but not limited to stainless steel. The panels 340 may be made of any suitable material, including but not limited to stainless steel, which may be partially or completely covered with a heat-resistant fabric. The foldable firepit supports 360, feet 385, and cross-member feet 395 may be made of any suitable material, such as stainless steel partially or completely covered by a soft, tractile, heat-resistant polymer such as silicone. Other materials may be used instead or in addition, for any of the components described herein, including metals, ceramics, composites, polymers, etc.

Figure 4A:
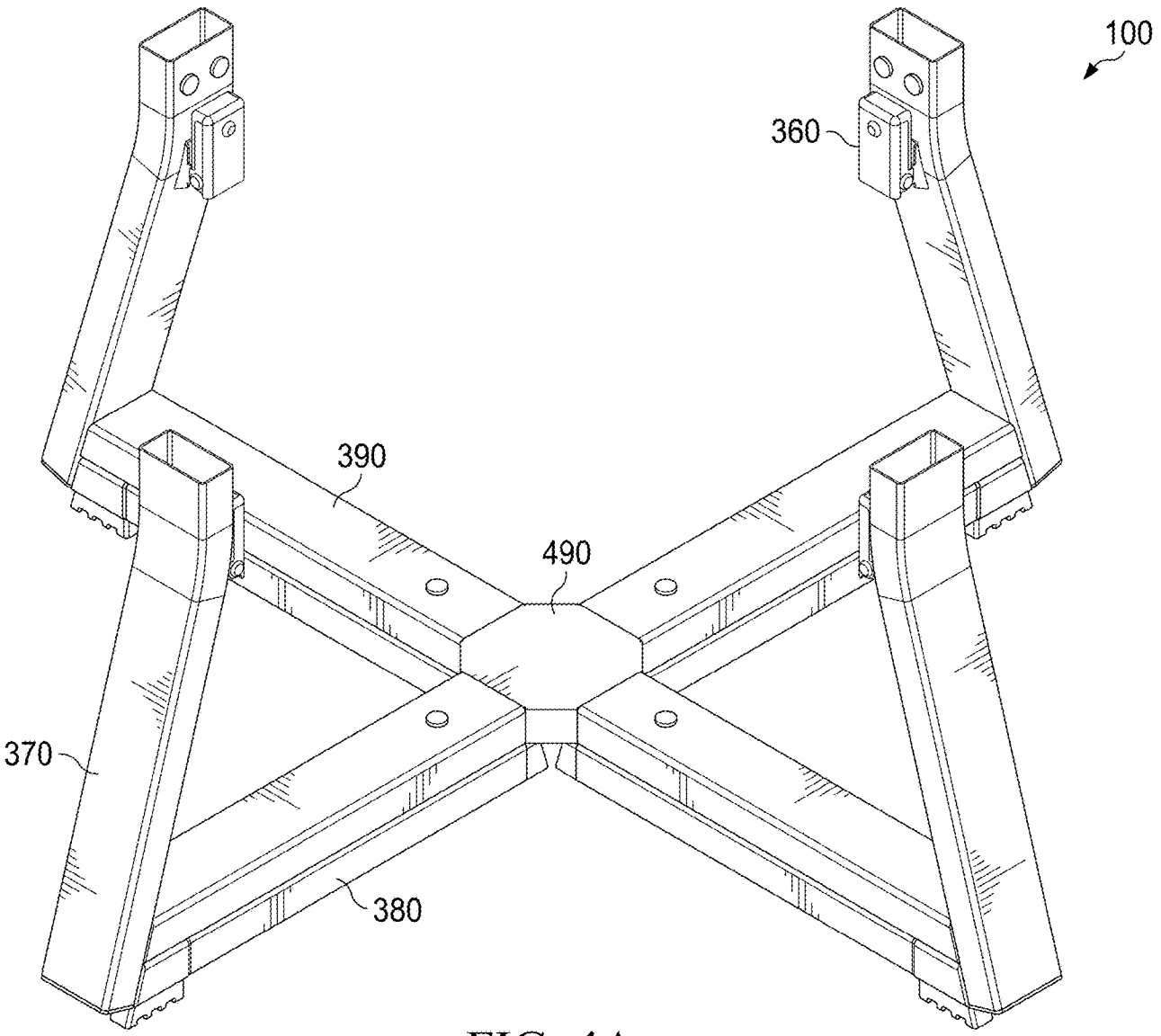
FIG. 4A is a front top perspective view of at least a portion of an example collapsible firepit stand, in accordance with at least one embodiment of the present disclosure.

FIG. 4A is a front top perspective view of at least a portion of an example collapsible firepit stand 100, in accordance with at least one embodiment of the present disclosure. In the example shown in FIG. 4, the firepit stand 100 is in a collapsed state, with the legs 380 folded under the cross members 390, and the foldable firepit supports 360 folded upward in their shipping or storage configuration. As can be seen, the cross members 390 are fixedly connected, such as by a weld, to the leg uprights 370 and to a central hub 490. The legs 380 in contrast are removably attached to the leg uprights 370 as described herein.

Figure 4C:
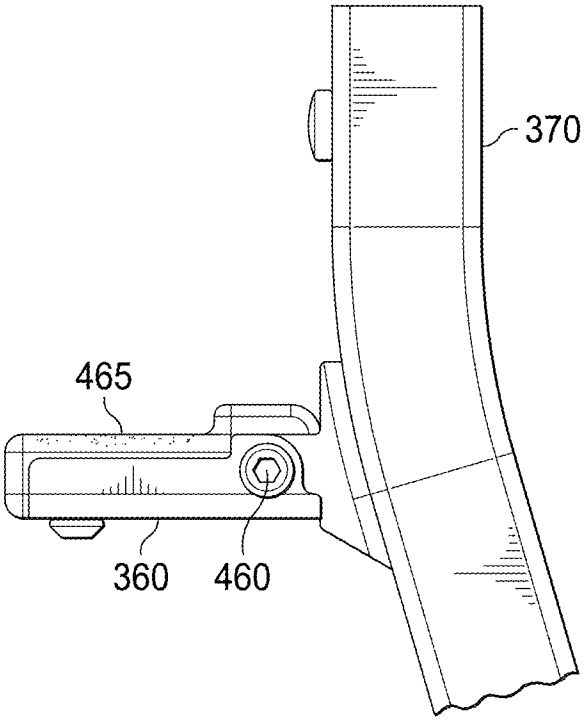
FIG. 4C is a side view of an example foldable firepit support in its downward-folded or horizontal configuration, in accordance with at least one embodiment of the present disclosure.
Figure 4B:
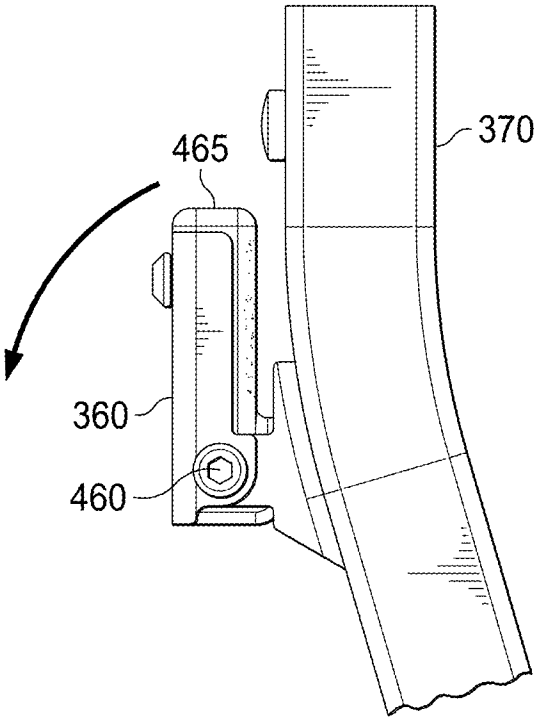
FIG. 4B is a side view of an example foldable firepit support, in its upward-folded or vertical configuration, in accordance with at least one embodiment of the present disclosure.

FIG. 4B is a side view of an example foldable firepit support 360, in its upward-folded or vertical configuration, in accordance with at least one embodiment of the present disclosure. In this configuration, the distance between opposing firepit supports 360 is greater than the width or diameter D1 of the fire pit. Thus, when in the vertical configuration, the fire pit supports 360 do not support the bottom of the firepit, and thus allows the firepit to slide downward until the bottom of the firepit 150 is in contact with the tops of the cross members 390, as shown for example in FIG. 6. In the example shown in FIG. 4B, the firepit support 360 can be pivoted or folded down into a horizontal configuration by means of a hinge 460.

FIG. 4C is a side view of an example foldable firepit support 360 in its downward-folded or horizontal configuration, in accordance with at least one embodiment of the present disclosure. In this configuration, the distance between opposing firepit supports 360 is less than the width or diameter D1 of the fire pit. Thus, when in the horizontal configuration, the firepit support 360 supports the bottom of the firepit 150, as shown for example in FIG. 5. In the example shown, the firepit support 360 includes an upward-facing pad 465 made of a soft, tractile, insulative material such as silicone. Depending on the implementation, the pad 465 may performs any of a variety of functions. Some examples include: (1) preventing slippage of the firepit, (2) cushioning the firepit, and (3) limiting heat transfer between the firepit 150 and the leg upright 370.

Figure 4D:
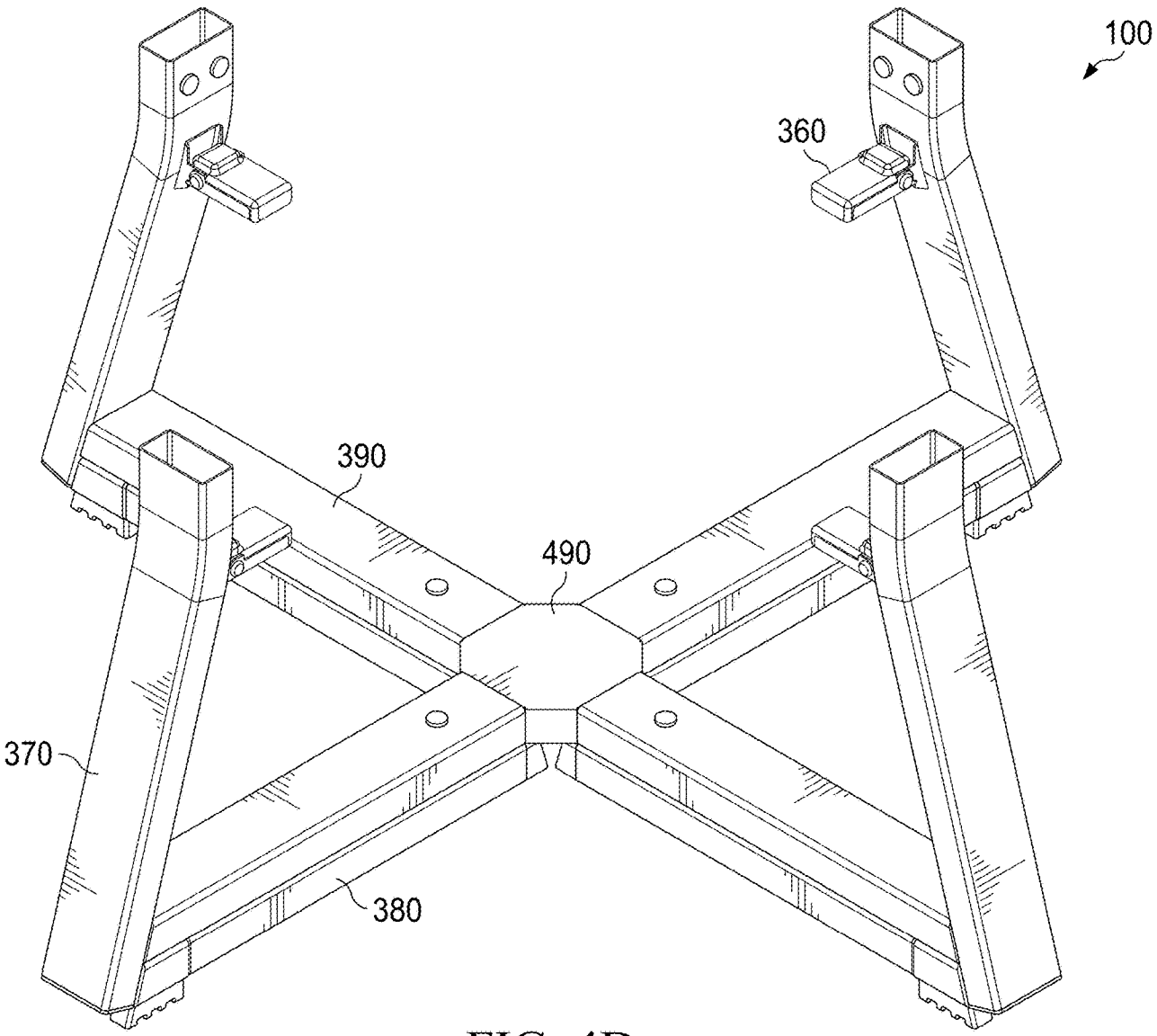
FIG. 4D is a top front perspective view of at least a portion of an example collapsible firepit stand, in accordance with at least one embodiment of the present disclosure.

FIG. 4D is a top front perspective view of at least a portion of an example collapsible firepit stand 100, in accordance with at least one embodiment of the present disclosure. FIG. 4D is similar to FIG. 4A, except that the foldable firepit supports 360 are folded down into their horizontal configurations, such that they can support the bottom of the firepit when the firepit is placed within the collapsible firepit stand.

Figure 5:
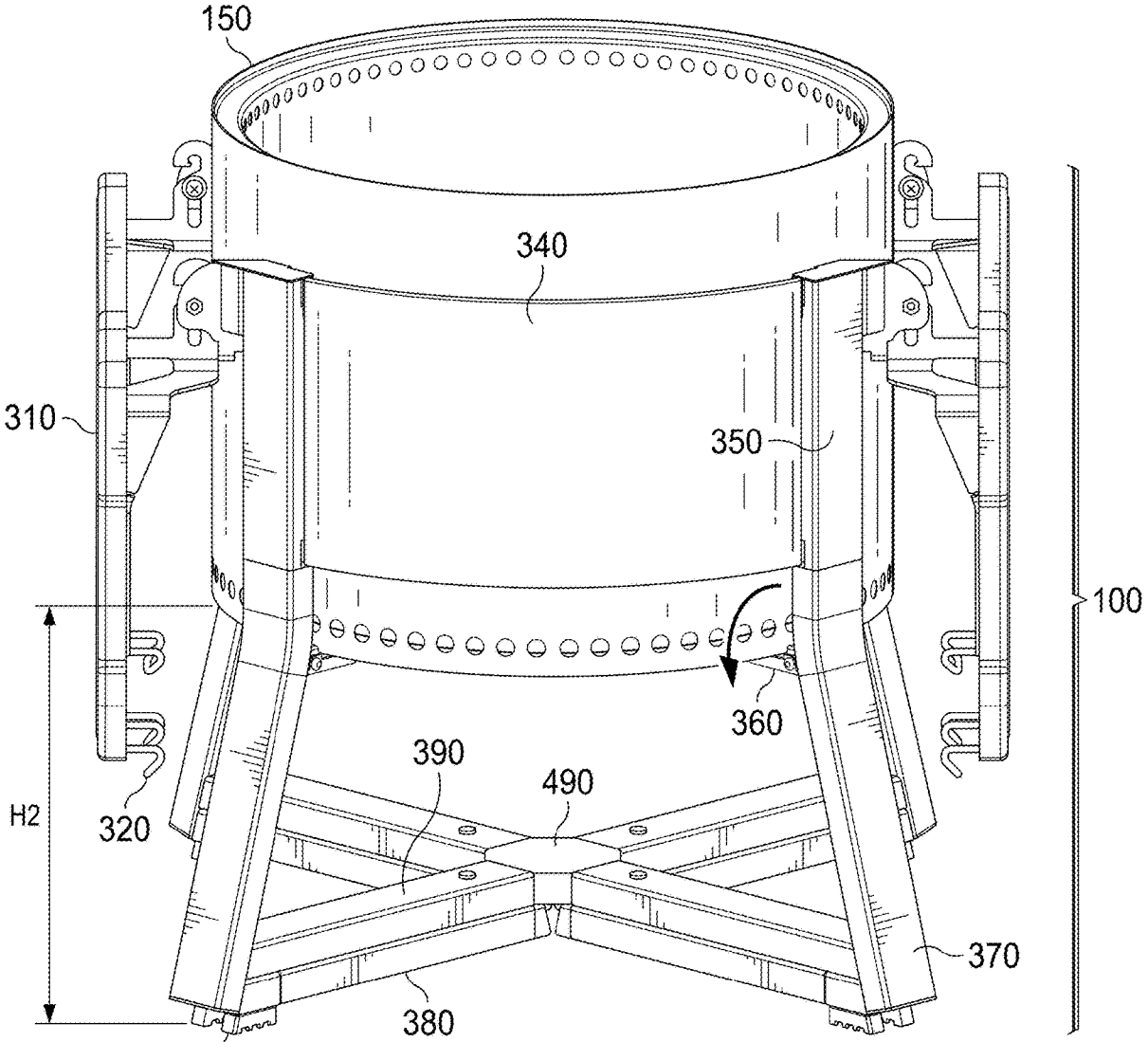
FIG. 5 is a top front perspective view of an example firepit supported by a firepit stand in its partially collapsed configuration, in accordance with at least one embodiment of the present disclosure.

FIG. 5 is a top front perspective view of an example firepit 150 supported by a firepit stand 100 in its partially collapsed configuration, in accordance with at least one embodiment of the present disclosure. Visible are the shelves 310 in a downward-folded storage configuration. Also visible are the utensil hooks 320, panel 340, shelf uprights 350, and foldable firepit supports 360 in their downward-folded or horizontal configuration, such that they can support the bottom of the firepit 150. Also visible are the leg uprights 370, legs 380, cross members 390, hub 490, and silicone feet 395. In this partially collapsed configuration, the firepit 150 is raised to a height H2, which is less than H1, but which may nevertheless keep the bottom of the firepit from damaging the surface on which the collapsible firepit stand 100 is standing. Thus, the firepit 150 can be used to generate light and heat by burning combustible material such as wood, paper, etc., and (with the addition of accessories such as a drop-in charcoal adapter and/or grilling pan) may be useful for grilling or other cooking by a seated cook.

Figure 6:
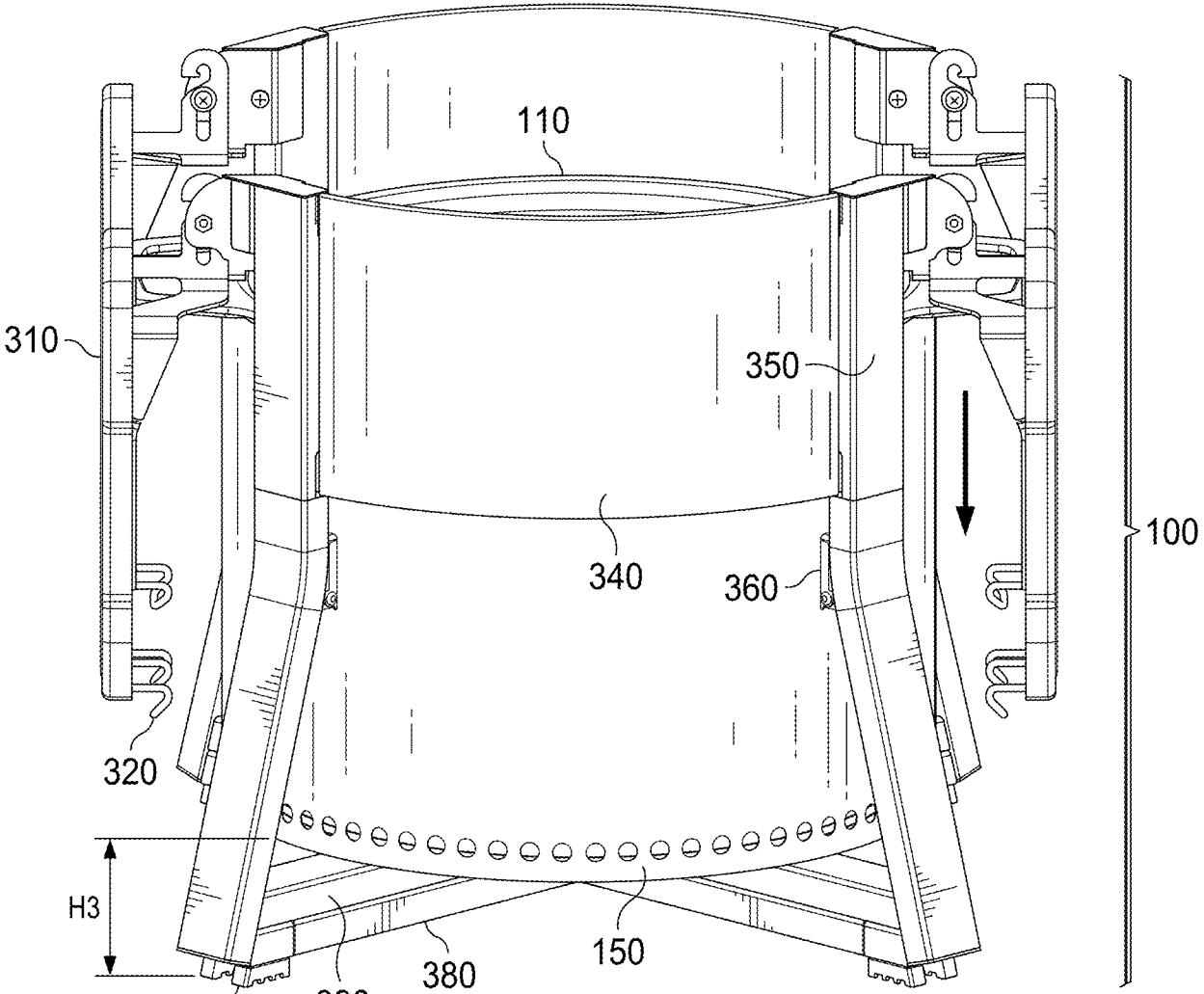
FIG. 6 is a top front perspective view of an example firepit supported by a firepit stand in its fully collapsed configuration, in accordance with at least one embodiment of the present disclosure.

FIG. 6 is a top front perspective view of an example firepit 150 supported by a firepit stand 100 in its fully collapsed configuration, in accordance with at least one embodiment of the present disclosure. FIG. 6 is similar to FIG. 5, except that the foldable firepit supports 360 have been folded upward into their vertical or storage orientation, such that the firepit 150 can slide down until it rests directly on the cross members 390 and hub 490 (see FIG. 5) at a height H3, which is less than H1 and H2, and may offer less protection to surfaces than heights H1 and H2. Nevertheless, the cross members 390, legs 380, and feet 395 prevent direct contact between the bottom of the firepit 150 and the surface 210 on which the collapsible firepit stand rests (see FIG. 2). Thus, this configuration is still more protective to surfaces than the firepit 150 by itself, with no firepit stand 100. Consistent with the storage configuration, FIG. 6 also shows the grilling pan 110 in a stowed or storage configuration resting on the edges of the fire pit 150 and still having its handles sized to be equal to or within an outer boundary defined by edges forming a maximum width of the firepit stand 100. Thus, the firepit system 105 (FIG. 1) can be stowed in this storage configuration giving a minimum form or volume.

The dimensions of the shelves 310 are such that when the shelves 310 are folded in a vertical position and the legs 380 are folded in a horizontal position, the shelves 310 and utensil hooks 320 do not touch the ground.

Figure 7A:
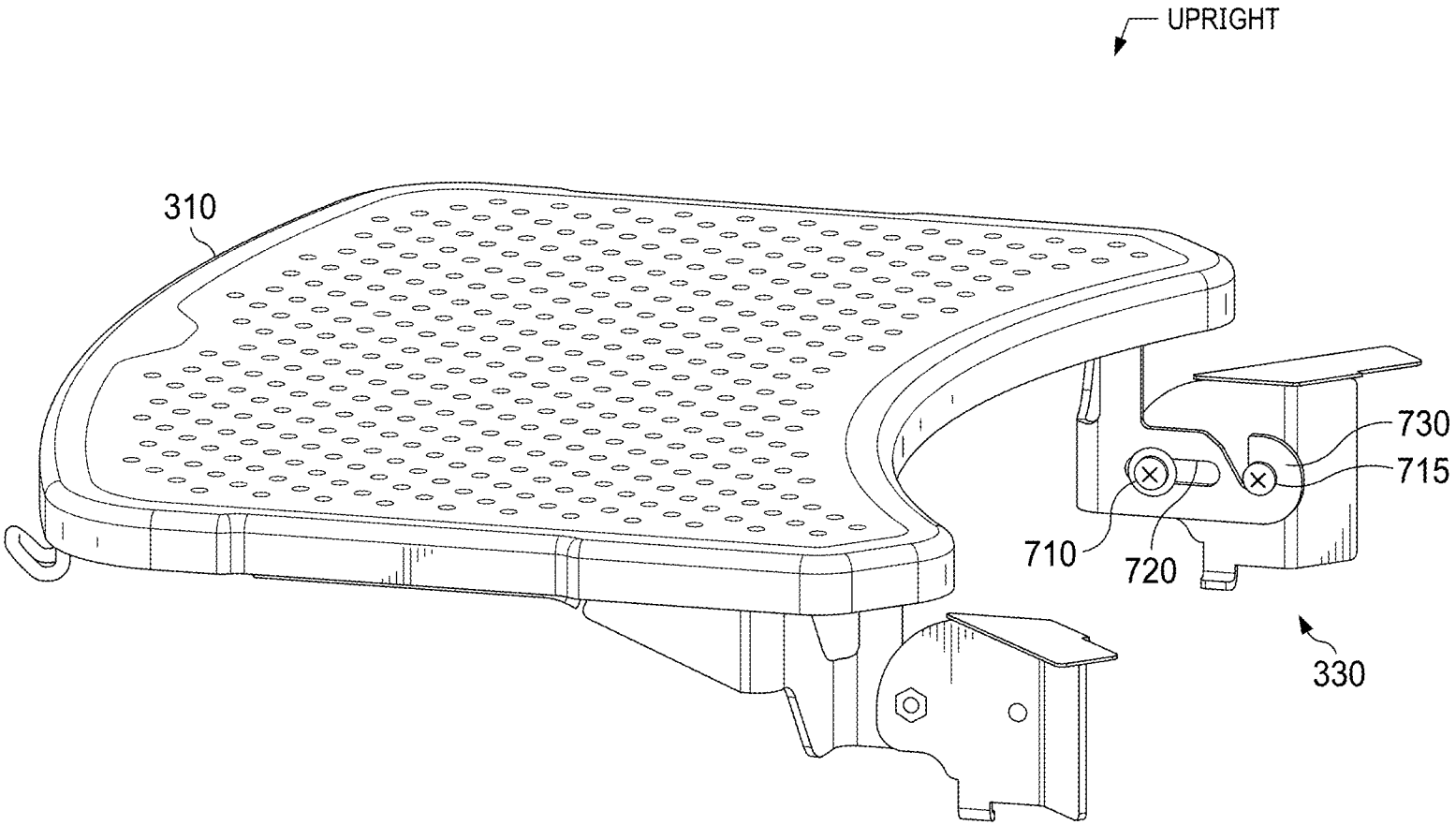
FIG. 7A is a side perspective view of a shelf and its hinge mechanism, in accordance with at least one embodiment of the present disclosure.

FIG. 7A is a side perspective view of a shelf 310 and its hinge mechanism 330, in accordance with at least one embodiment of the present disclosure. The hinge mechanism 330 includes an outer screw 710, an inner screw 715, a slot 720, and a hook 730. In the example shown in FIG. 7, the hook 730 is hooked around the inner screw 715, while the outer screw 710 is captive within the slot 720. In the example shown in FIG. 7A, the shelf is in a locked, horizontal position. However, manipulation of the hinge mechanism 330 by a user can transition the shelf 310 from its locked, horizontal configuration to an unlocked, vertical configuration, as shown below in FIGS. 7B-7F.

Figure 7B:
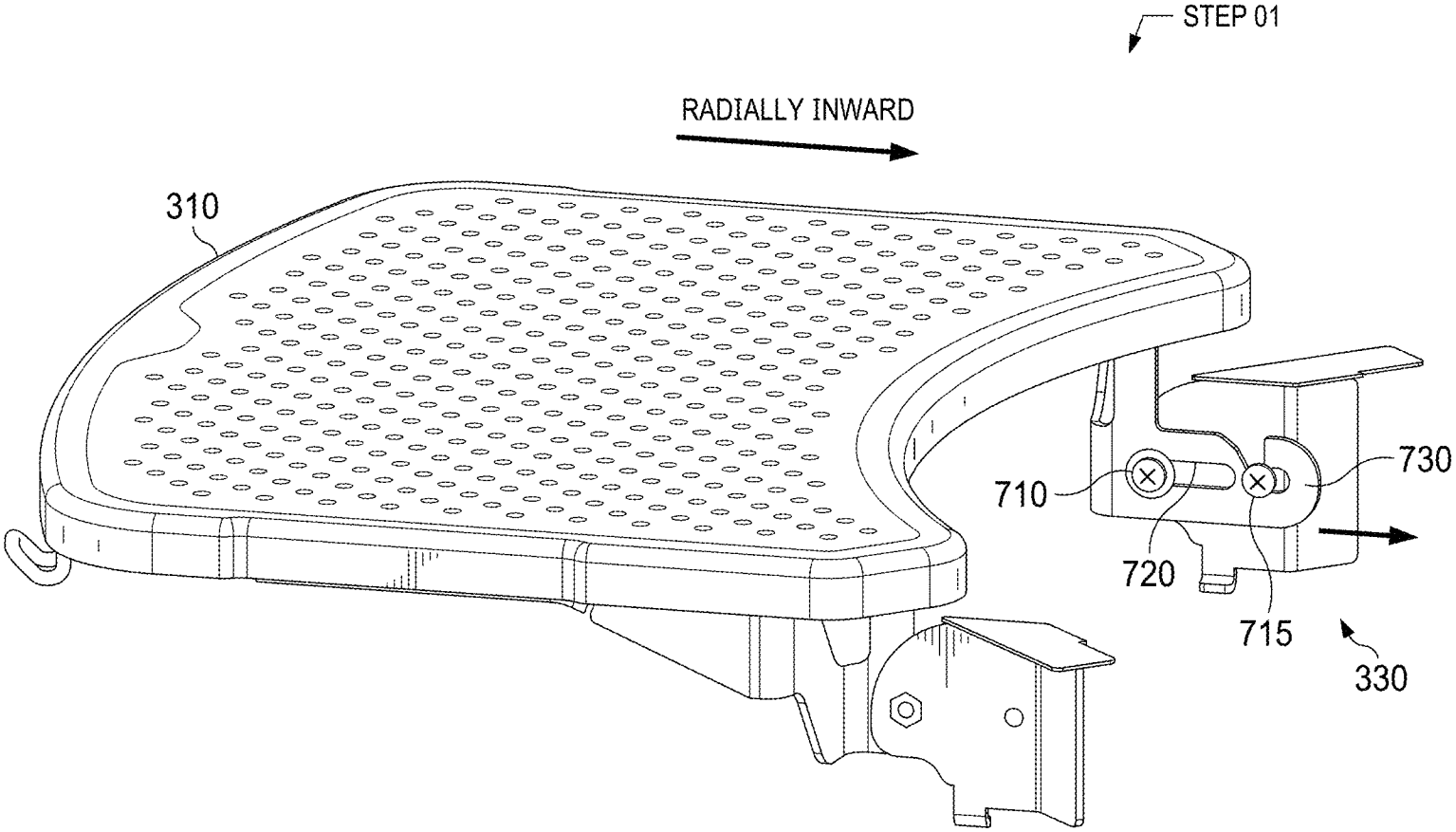
FIG. 7B is a side perspective view of a shelf and its hinge mechanism, in accordance with at least one embodiment of the present disclosure.

FIG. 7B is a side perspective view of a shelf 310 and its hinge mechanism 330, in accordance with at least one embodiment of the present disclosure. In the example shown in FIG. 7B, the shelf 310 is pushed radially inward such that the outer screw 710 slides along the slot 720, while the inner screw 715 unlocks from the hook 730.

Figure 7C:
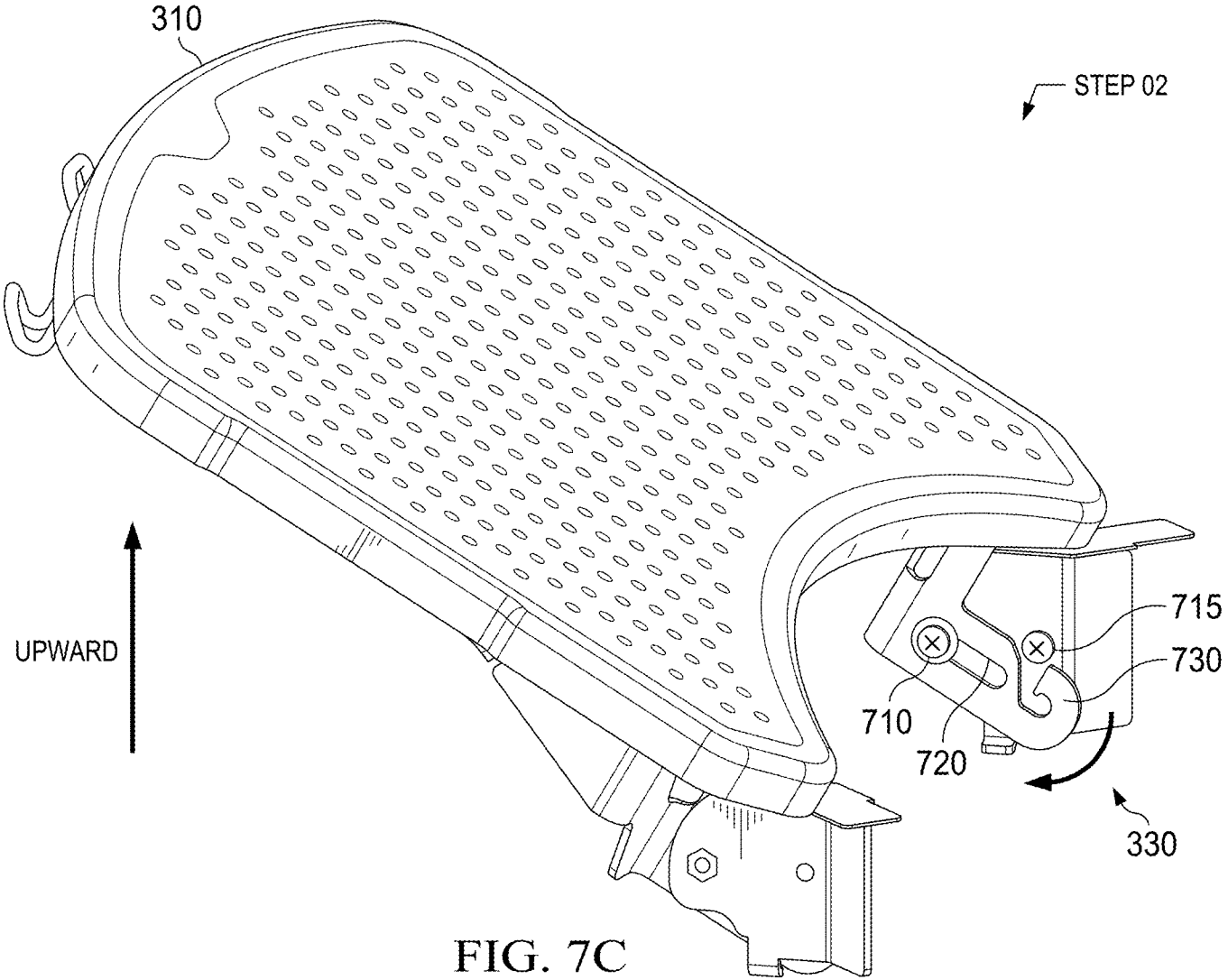
FIG. 7C is a side perspective view of a shelf and its hinge mechanism, in accordance with at least one embodiment of the present disclosure.

FIG. 7C is a side perspective view of a shelf 310 and its hinge mechanism 330, in accordance with at least one embodiment of the present disclosure. In the example shown in FIG. 7C, the shelf 310 is rotated upward to disengage the hook 730 from the inner screw 715.

Figure 7D:
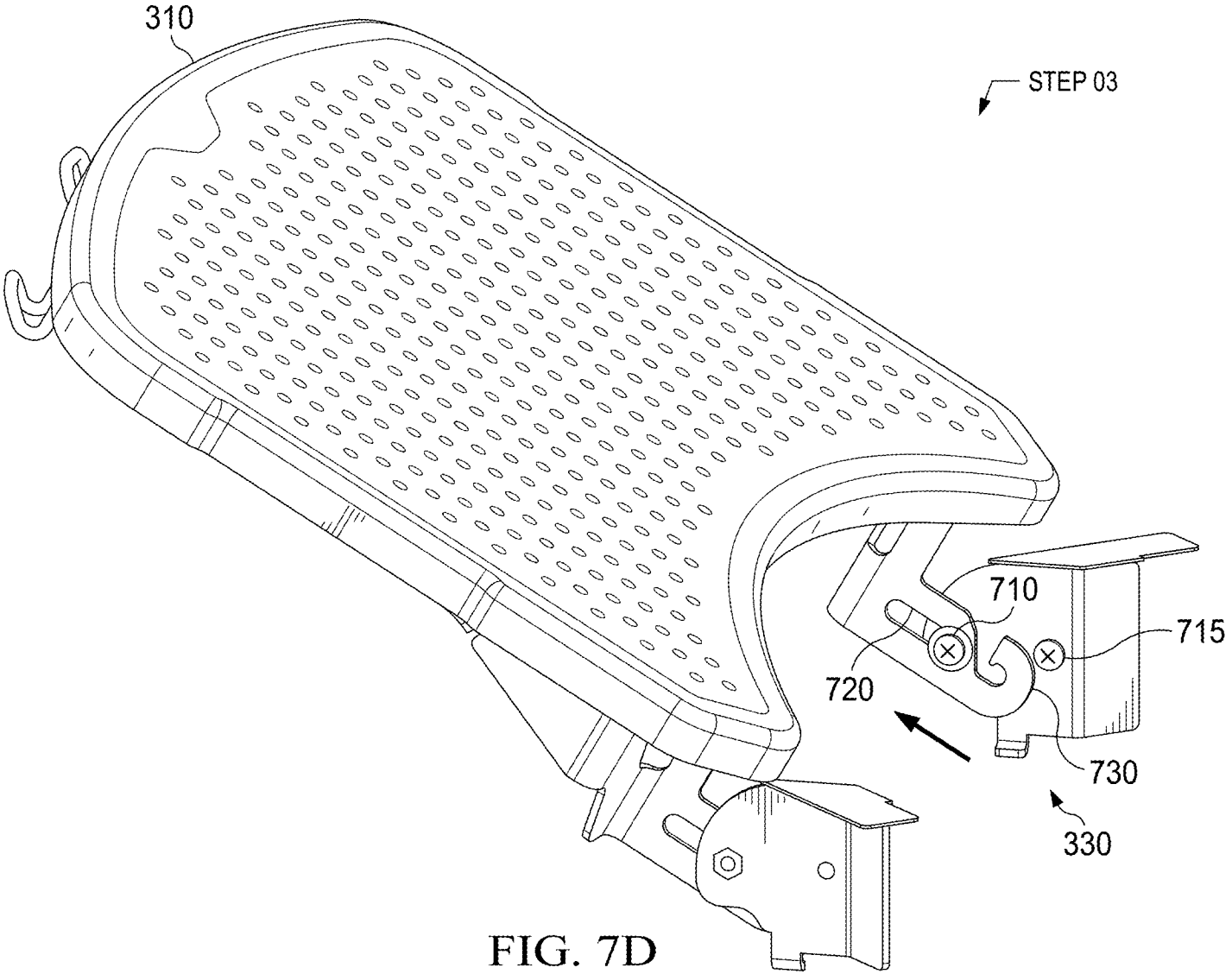
FIG. 7D is a side perspective view of a shelf and its hinge mechanism, in accordance with at least one embodiment of the present disclosure.

FIG. 7D is a side perspective view of a shelf 310 and its hinge mechanism 330, in accordance with at least one embodiment of the present disclosure. In the example shown in FIG. 7D, the shelf 310 is slid in a diagonal upward/radially outward direction, such that the slot 720 moves to its outermost position against the outer screw 710, and such that the hook 730 completely clears the inner screw 715.

Figure 7E:
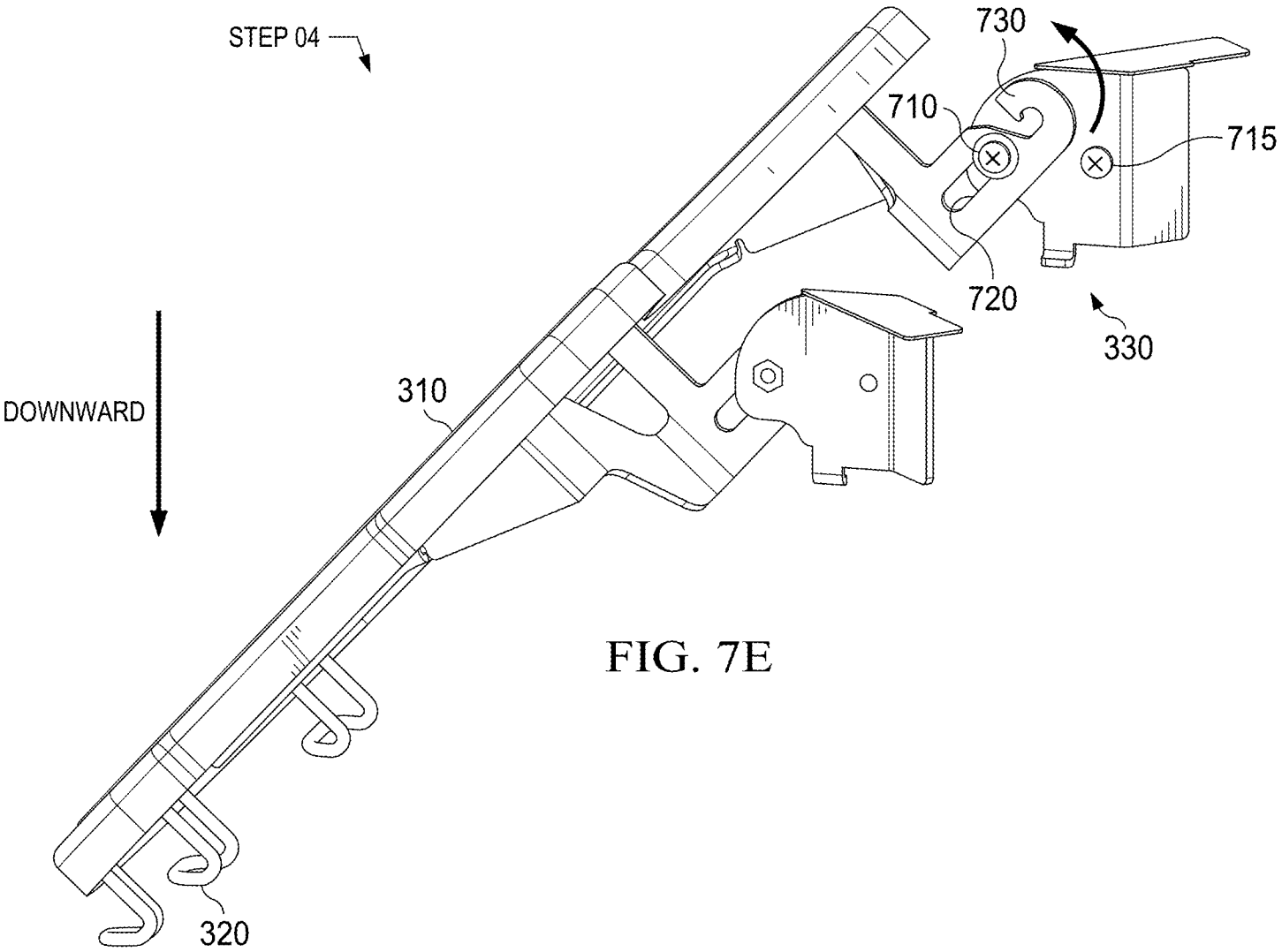
FIG. 7E is a side perspective view of a shelf and its hinge mechanism, in accordance with at least one embodiment of the present disclosure.

FIG. 7E is a side perspective view of a shelf 310 and its hinge mechanism 330, in accordance with at least one embodiment of the present disclosure. In the example shown in FIG. 7E, the shelf 310 is rotated downward until it is hanging in a fully vertical direction.

Figure 7F:
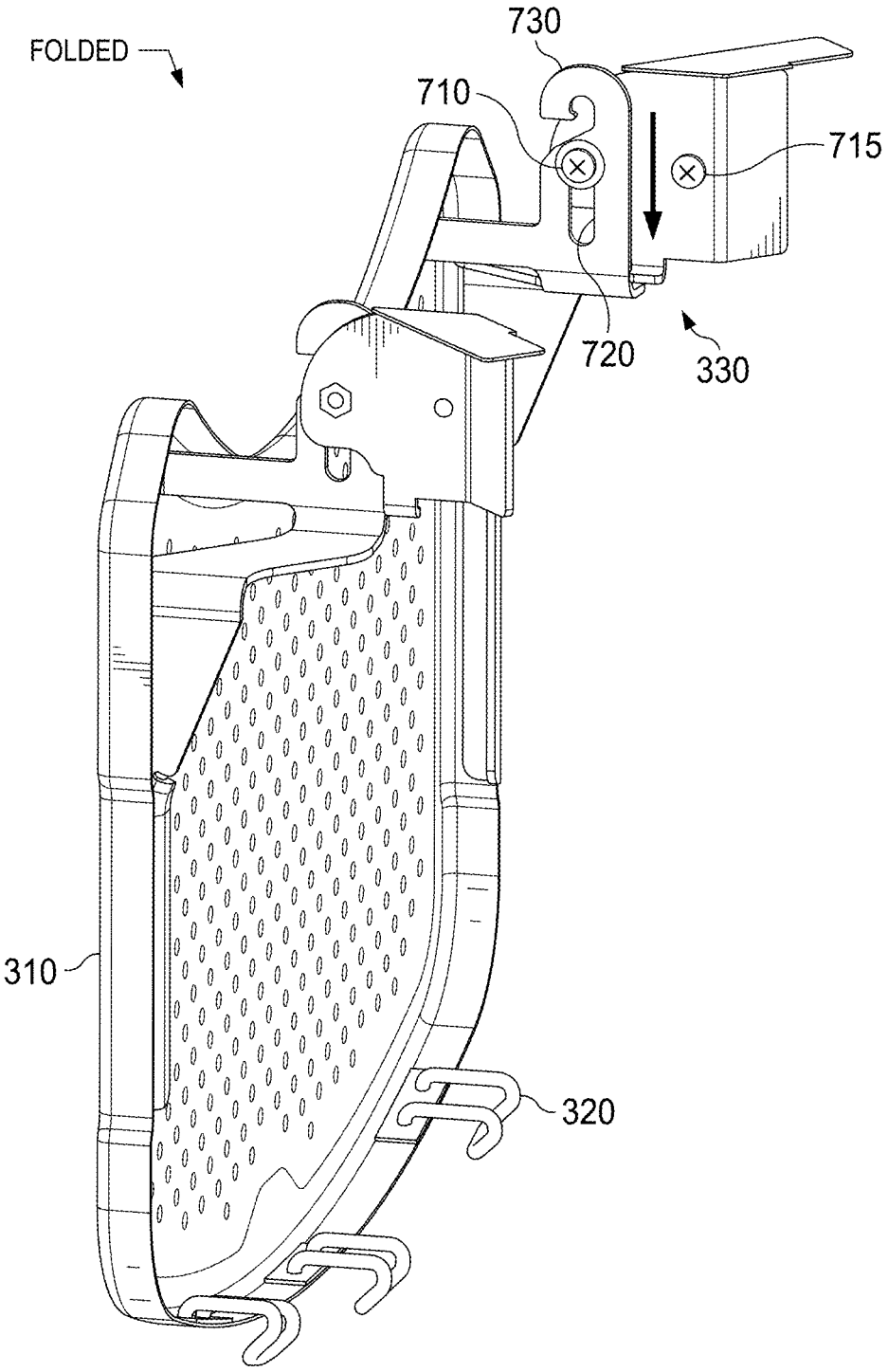
FIG. 7F is a side perspective view of a shelf and its hinge mechanism, in accordance with at least one embodiment of the present disclosure.

FIG. 7F is a side perspective view of a shelf 310 and its hinge mechanism 330, in accordance with at least one embodiment of the present disclosure. In the example shown in FIG. 7F, the shelf 310 is now hanging in an unlocked, vertical configuration. This may be done for example for shipping, transportation to and from the site of use, or storage of the firepit and collapsible firepit stand. It is understood that the shelf 310 can be returned to its locked horizontal configuration by reversing the steps 7F-7A.

Figure 8:
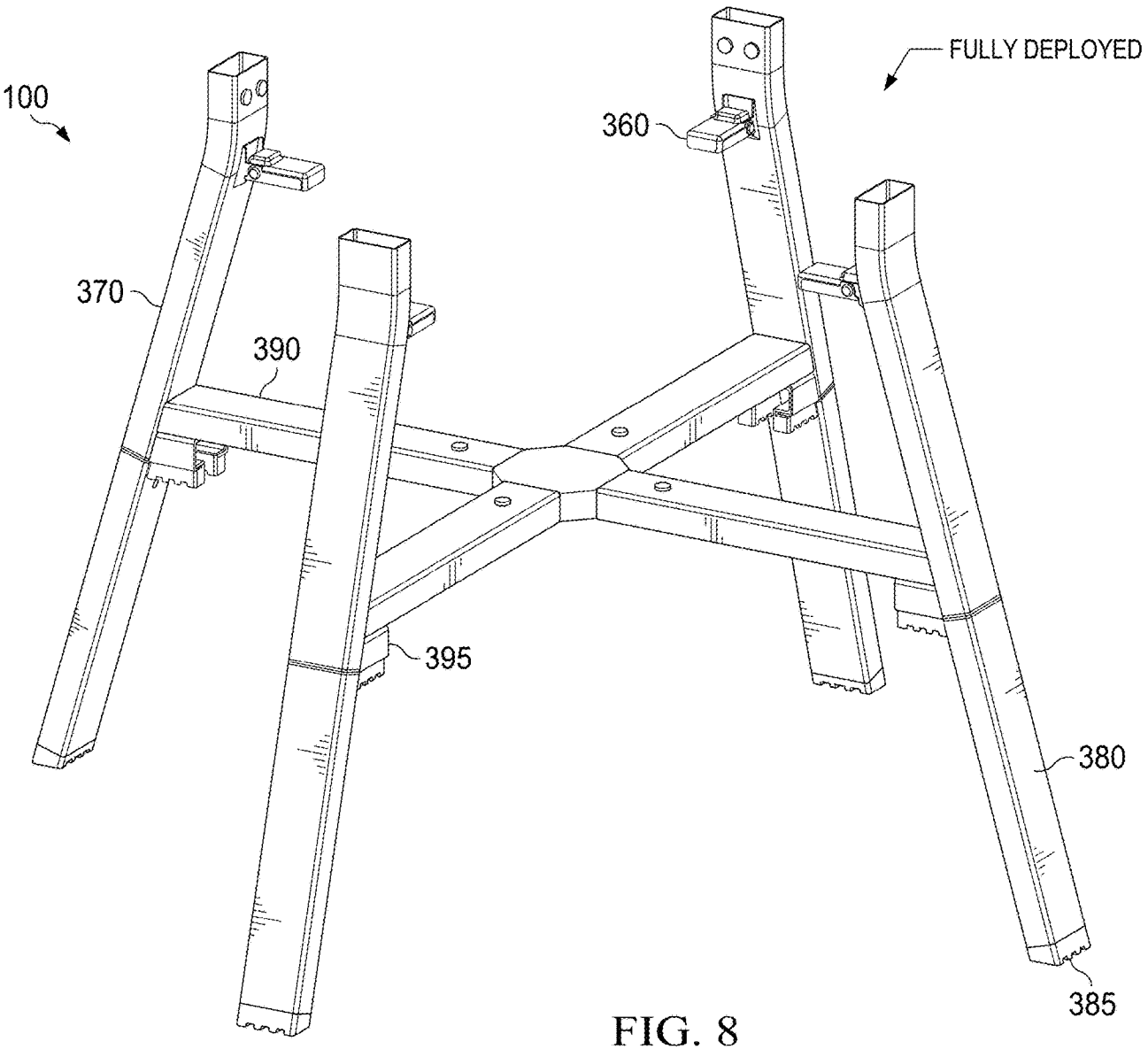
FIG. 8 is a front perspective view of at least a portion of an example collapsible firepit stand in its fully deployed configuration, in accordance with at least one embodiment of the present disclosure.

FIG. 8 is a front perspective view of at least a portion of an example collapsible firepit stand 100 in a standing or fully deployed configuration, in accordance with at least one embodiment of the present disclosure. In the example shown in FIG. 8, the legs 380 are locked in place within the leg uprights 370 such that they in a substantially vertical orientation and are not in contact with the cross members 390. The foldable firepit supports 360 are in their unfolded, horizontal position. In this configuration, the collapsible firepit stand 100 can support the firepit 150 as shown for example in FIG. 2.

Figure 9:
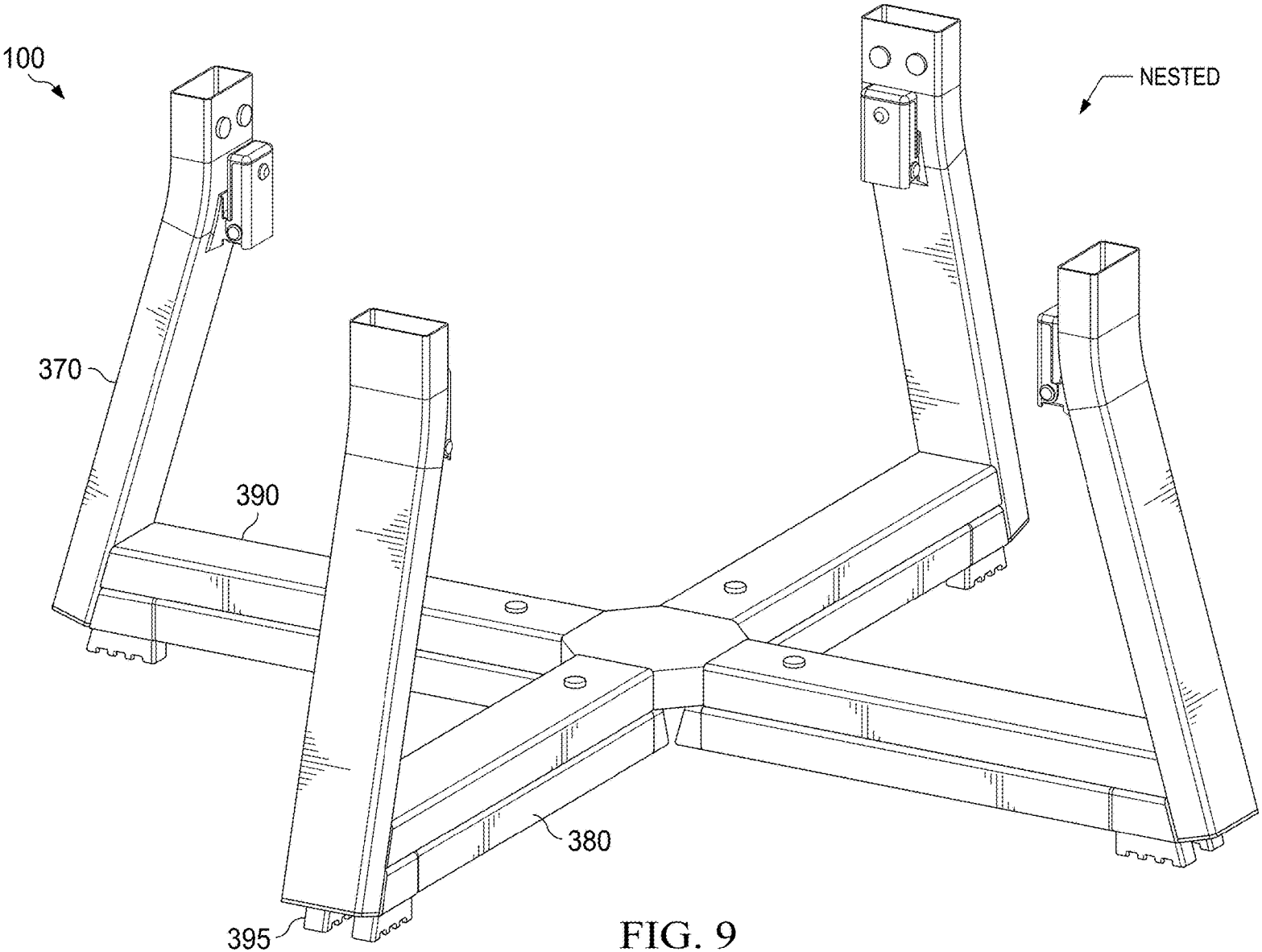
FIG. 9 is a front perspective view of at least a portion of an example collapsible firepit stand in its fully collapsed configuration, in accordance with at least one embodiment of the present disclosure.

FIG. 9 is a front perspective view of at least a portion of an example collapsible firepit stand 100 in its fully collapsed configuration, in accordance with at least one embodiment of the present disclosure. In the example shown in FIG. 9, the legs 380 are detached from the leg uprights 370, and are attached instead to the feet 395 of the cross members 390, such that the legs 380 are situated parallel to and in contact with the cross members 390. The foldable firepit supports 360 are in their folded, vertical position. In this collapsed configuration, which could also be a shipping, storage, or stowed configuration, the collapsible firepit stand 100 can support the firepit 150 as shown for example in FIG. 6.

FIGS. 10A through 10E show the process of transitioning the legs 380 from the configuration shown in FIG. 8 to the configuration shown in FIG. 9.

Figure 10A:
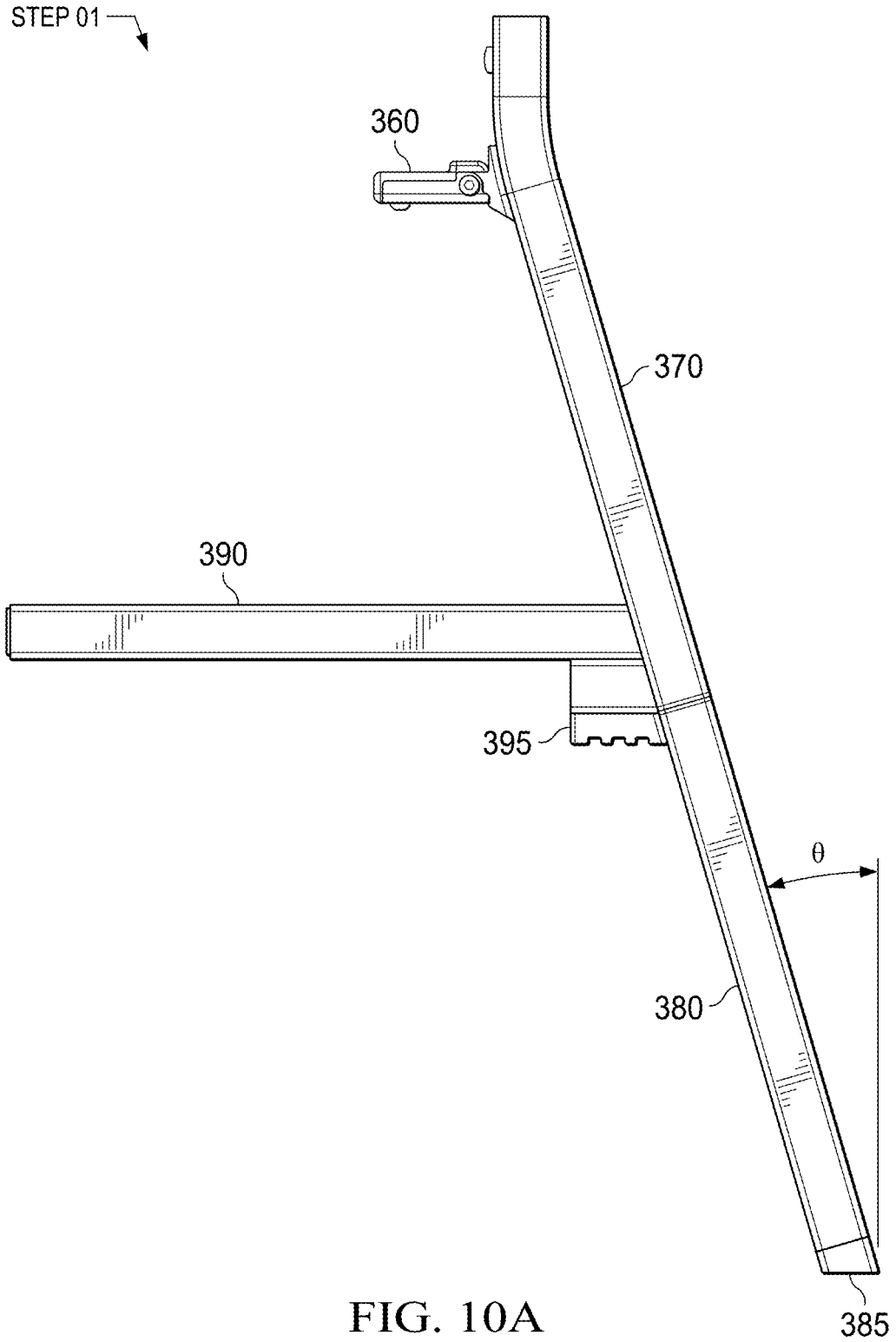
FIG. 10A is a side view of a leg, cross member, and leg upright of an example collapsible firepit stand in a standing or fully deployed configuration, in accordance with at least one embodiment of the present disclosure.

FIG. 10A is a side view of a leg 380, cross member 390, and leg upright 370 of an example collapsible firepit stand 100 in a standing or fully deployed configuration, in accordance with at least one embodiment of the present disclosure. In this configuration, a nesting feature 1020 (see FIG. 10B) of the leg 380 fits within the leg upright 370 by a friction fit, and/or by means of tension provided by a shock cord, elastic cord, or bungie cord 1010 (see FIG. 10B), such that the leg 380 is retained in a position parallel to and continuous with the leg upright 370. In this configuration, the leg 380 is in a substantially vertical orientation, e.g., at an angle 6 of 45 degrees or less with the vertical.

Figure 10B:
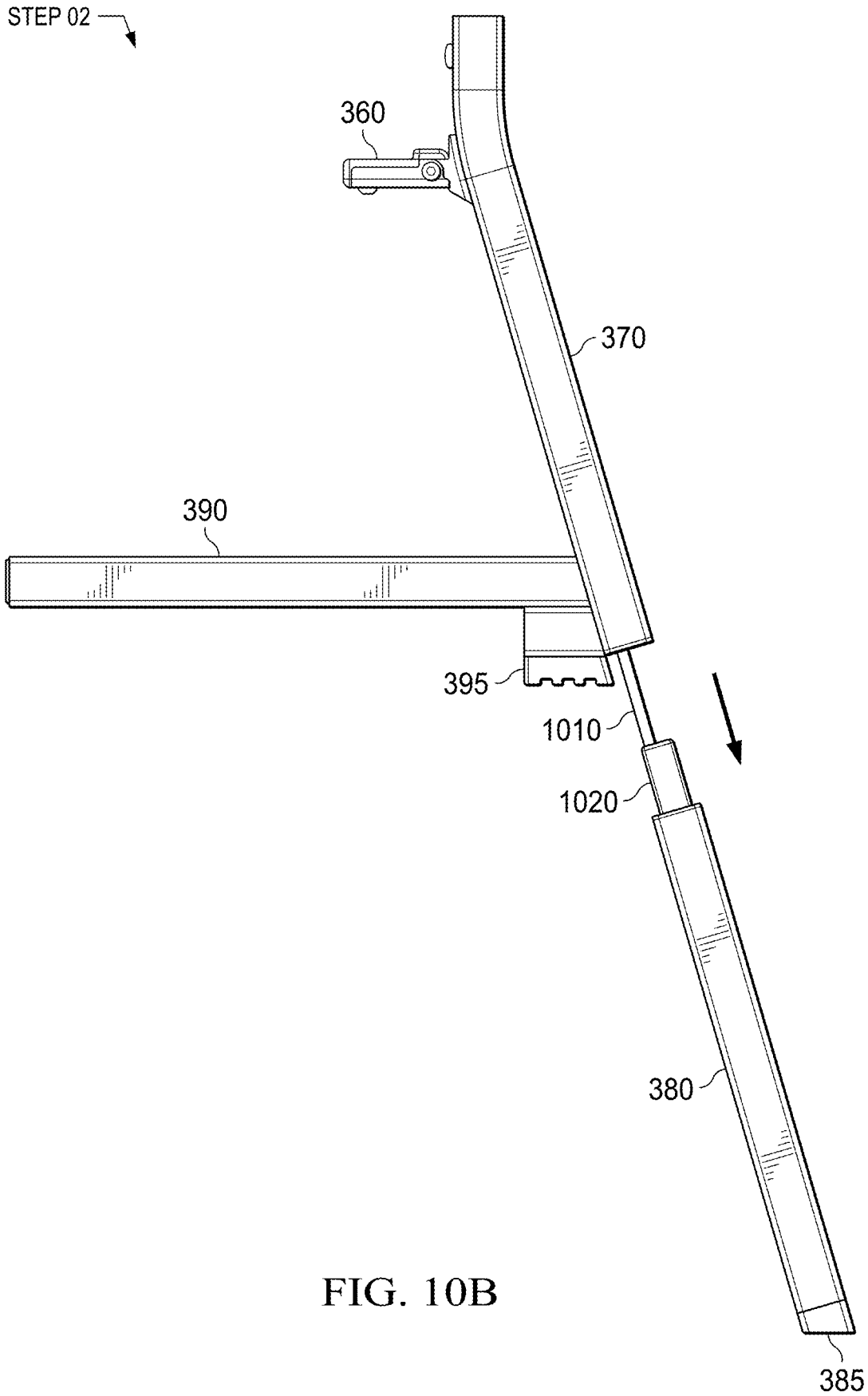
FIG. 10B is a side view of a leg, cross member, and leg upright of an example collapsible firepit stand in a partially collapsed configuration, in accordance with at least one embodiment of the present disclosure.

FIG. 10B is a side view of a leg 380, cross member 390, and leg upright 370 of an example collapsible firepit stand 100 in a partially collapsed configuration, in accordance with at least one embodiment of the present disclosure. In the example shown in FIG. 10B, the leg 380 has been pulled downward such that the shock cord or bungie cord 1010 is under tension, and the nesting feature 1020 is axially separated from and no longer within the leg upright 370.

Figure 10C:
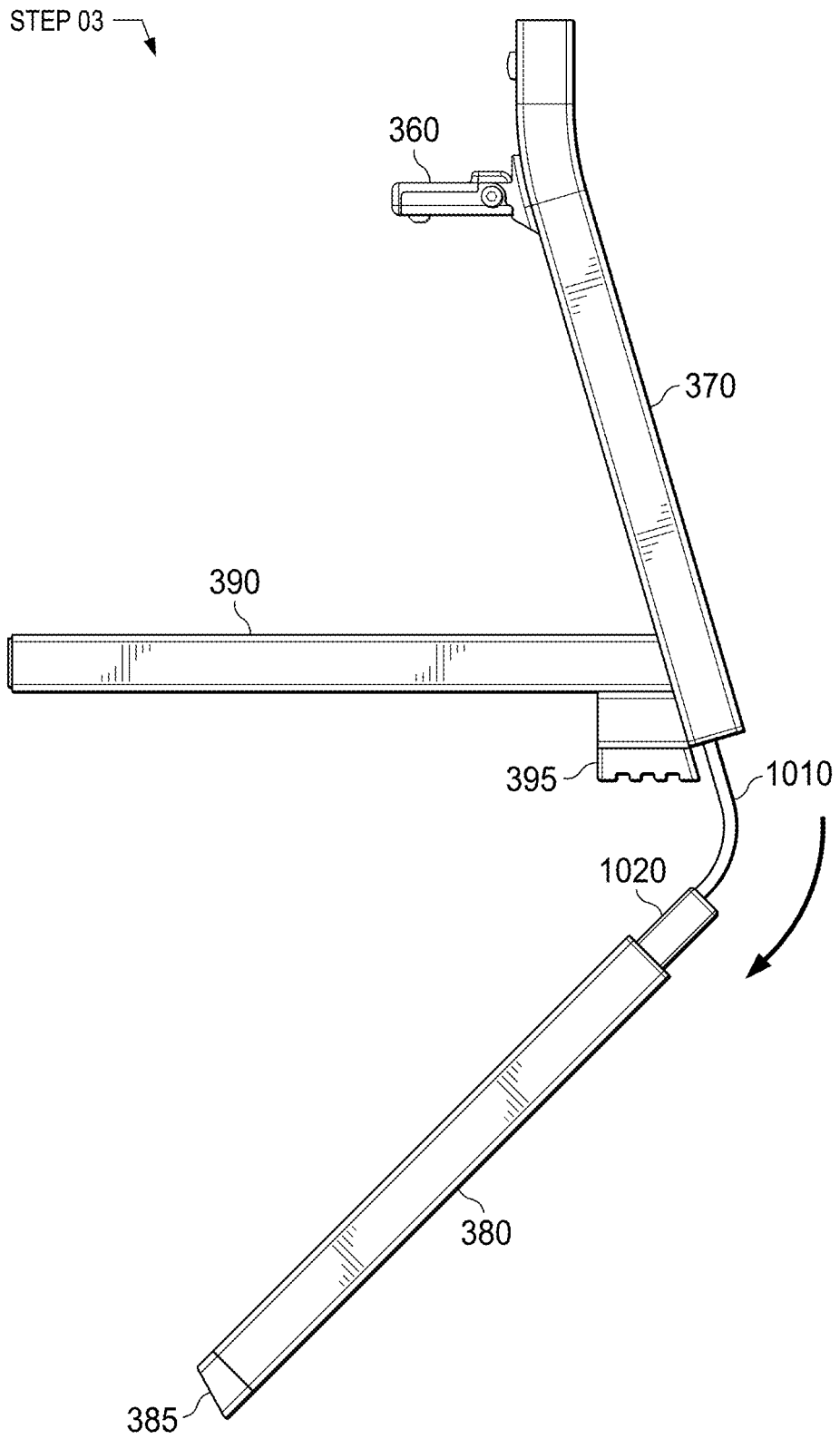
FIG. 10C is a side view of a leg, cross member, and leg upright of an example collapsible firepit stand in a partially collapsed configuration, in accordance with at least one embodiment of the present disclosure.

FIG. 10C is a side view of a leg 380, cross member 390, and leg upright 370 of an example collapsible firepit stand 100 in a partially collapsed configuration, in accordance with at least one embodiment of the present disclosure. In the example shown in FIG. 10C, the leg 380 is folded under the cross member 390.

Figure 10D:
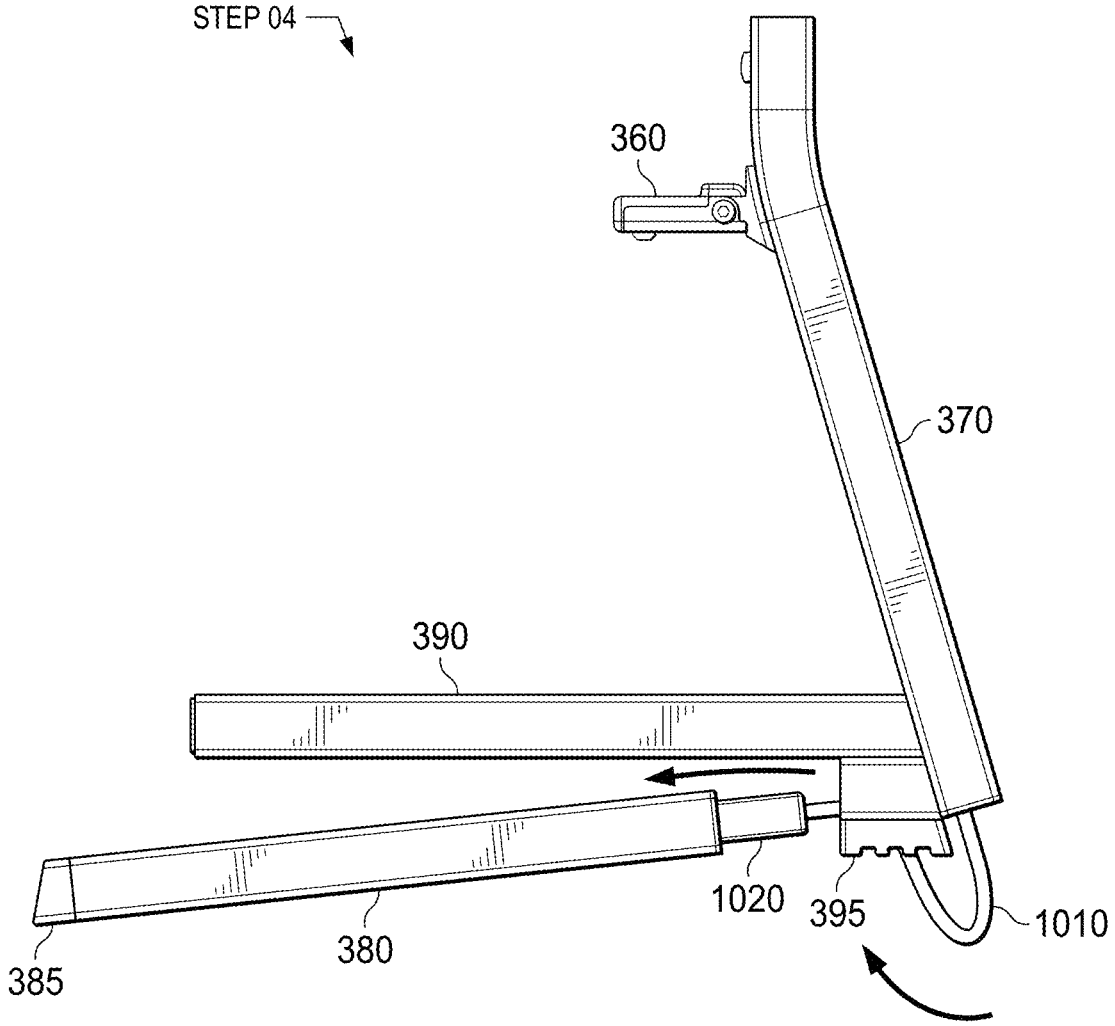
FIG. 10D is a side view of a leg, cross member, and leg upright of an example collapsible firepit stand in a partially collapsed configuration, in accordance with at least one embodiment of the present disclosure.

FIG. 10D is a side view of a leg 380, cross member 390, and leg upright 370 of an example collapsible firepit stand 100. In this example, the foot 395 is offset from the cross member 390 by a stow bar 396. The stow bar 396 is disposed between the foot 395 and the cross member 390. In this example, the stow bar 396 is a hollow bar with a slot 1110 (labeled in FIG. 11) sized and configured to receive the nesting feature 1020 of the leg 380 therein in a manner that selectively maintains the leg 380 in place directly below and aligned along the cross member 390. In the example shown in FIG. 10D, the leg 380 is positioned under the cross member 390 such that the bungie cord 1010 and nesting feature 1020 fit within a slot 1110 (see FIG. 11) of the foot 395 of the cross member 390.

Figure 10E:
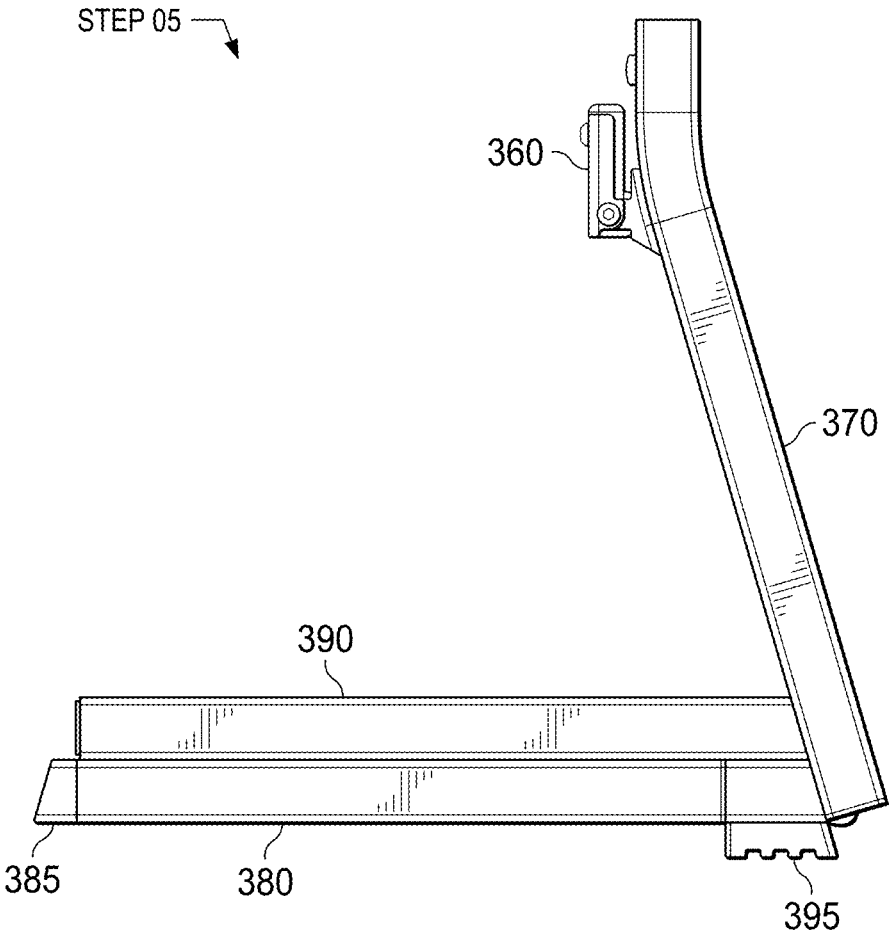
FIG. 10E is a side view of a leg, cross member, and leg upright of an example collapsible firepit stand in a fully collapsed configuration, in accordance with at least one embodiment of the present disclosure.

FIG. 10E is a side view of a leg 380, cross member 390, and leg upright 370 of an example collapsible firepit stand 100 in a fully collapsed configuration, in accordance with at least one embodiment of the present disclosure. In the example shown in FIG. 10E, the leg 380 is positioned under, parallel with, and in contact with the cross member 390, and is held in place via a friction fit between the nesting feature 1020 and the stow bar 396 or slot 1110 (see FIG. 11), and/or by tension on the bungie cord 1010 (see FIG. 10D). The foldable firepit support 360 has also been folded into its substantially vertical (e.g., within 45 degrees of vertical) position.

Figure 11:
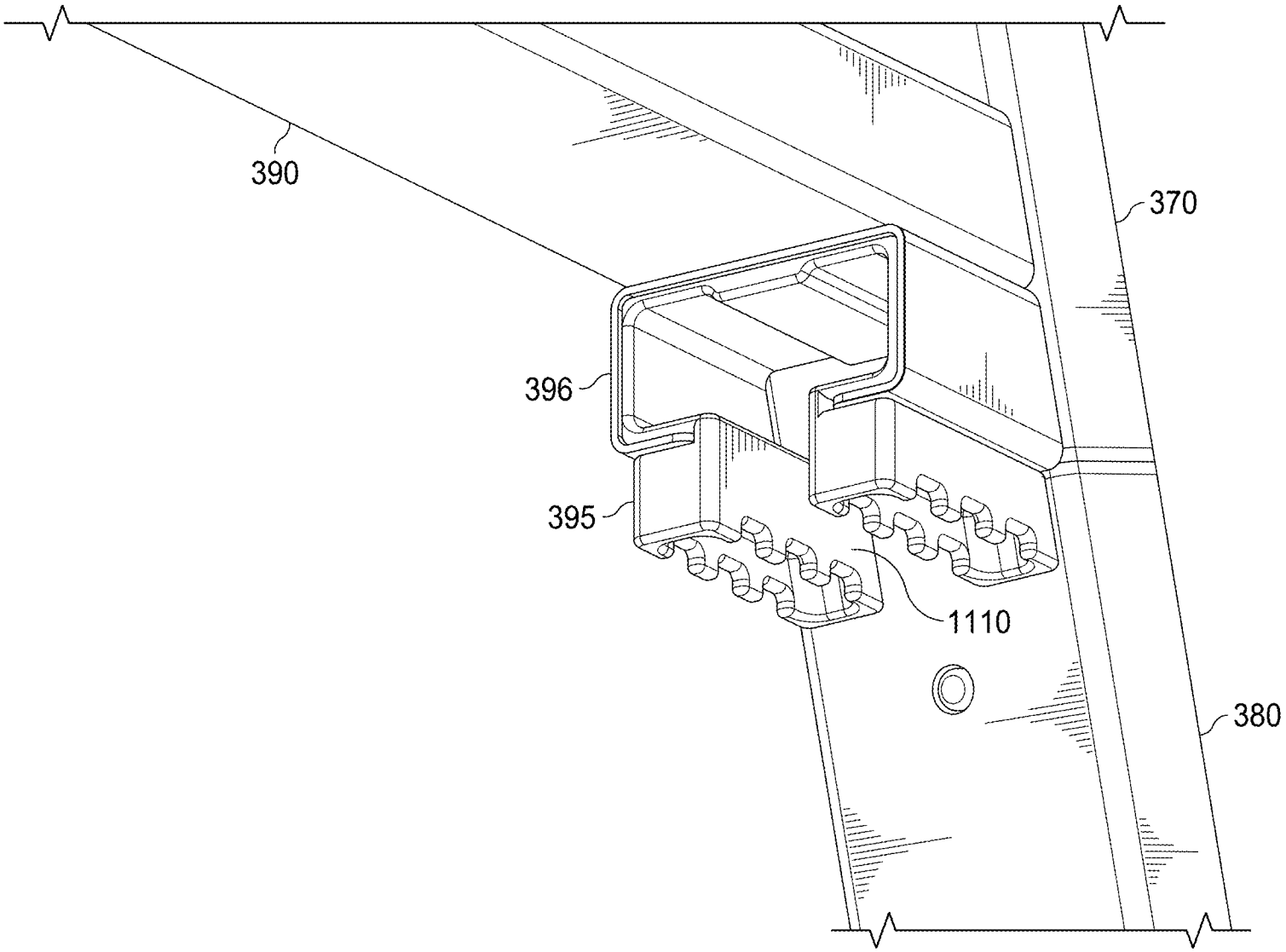
FIG. 11 is a perspective view of a leg, cross member, and leg upright of an example collapsible firepit stand in a fully deployed configuration, in accordance with at least one embodiment of the present disclosure.

FIG. 11 is a perspective view of a leg 380, cross member 390, and leg upright 370 of an example collapsible firepit stand 100 in a standing or fully deployed configuration, in accordance with at least one embodiment of the present disclosure. Also visible are the cross member 390, foot 395, stow bar 396, and cross member foot slot 1110. The slot 1110 extends through the foot and the stow bar 396 and is configured to receive the nesting feature 1020 and bungie cord 1010 (see FIG. 10D).

Figure 12:
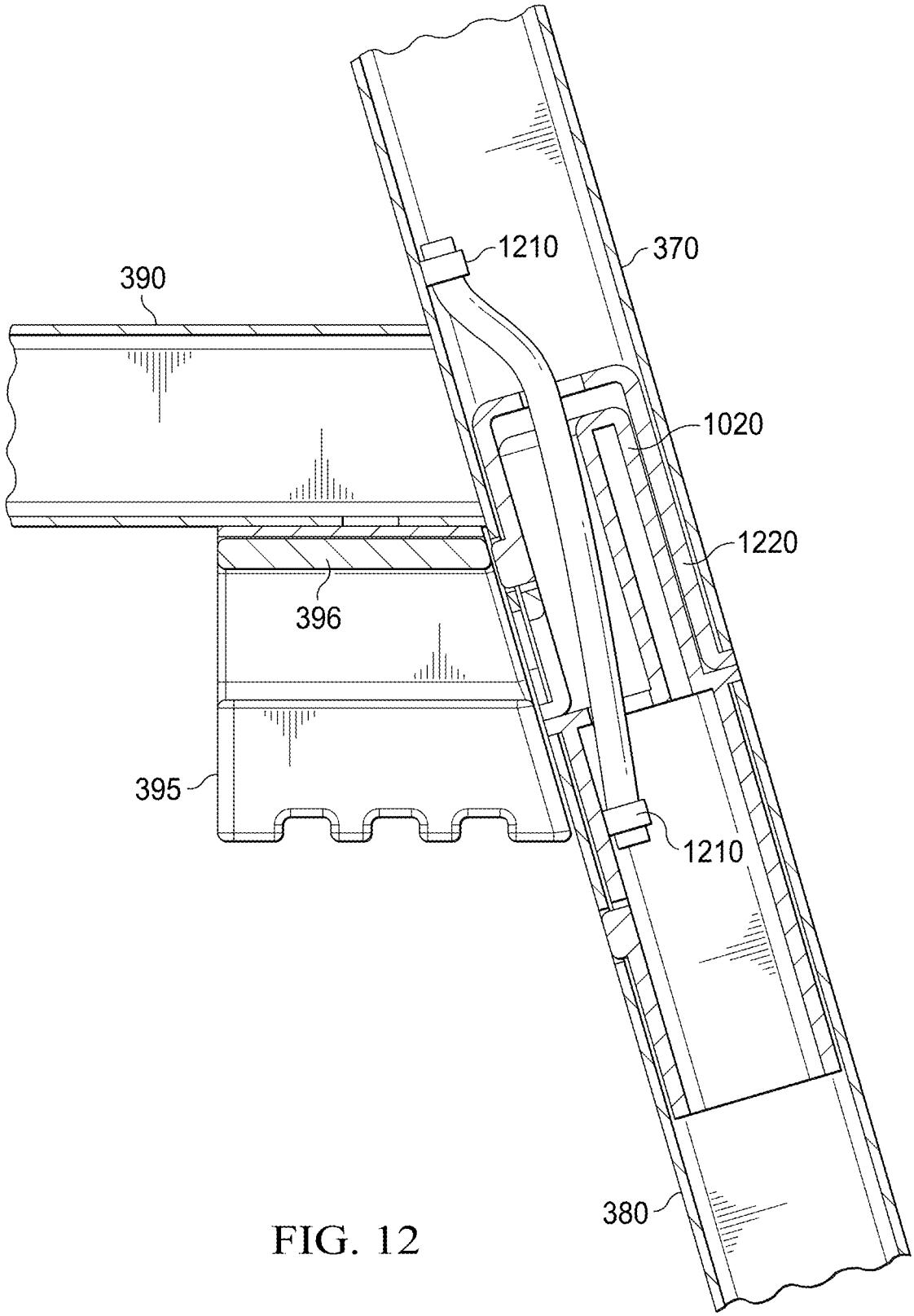
FIG. 12 is a side cross-sectional view of a leg, cross member, and leg upright of an example collapsible firepit stand in a fully deployed configuration, in accordance with at least one embodiment of the present disclosure.

FIG. 12 is a side cross-sectional view of a leg 380, cross member 390, and leg upright 370 of an example collapsible firepit stand 100 in a fully deployed configuration, in accordance with at least one embodiment of the present disclosure. Also visible are the cross member 390, cross member foot 395, bungie cord 1010, and nesting feature 1020. The nesting feature 1020 of the leg 380 forms a friction fit with a receiving feature 1220 of the leg upright 370. The elastic cord or bungie cord is held in place by two attachments 1210

(one within the leg 380 and the other within the leg upright 370) that keep the bungie cord 1010 in tension and thus help retain the nesting feature 1020 within the receiving feature 1220, thus maintaining the leg 380 in a position parallel to and colinear with the leg upright 370.

The bungie cord may be made of any suitable material, including but not limited to rubber covered with woven cloth. The leg 380, leg upright 370, cross member 390 may be made of any suitable material, including but not limited to stainless steel. The nesting feature 1020 and receiving feature 1220 may be made of any suitable material, including but not limited to plastic. Other materials may be used instead or in addition to those described herein, and the collapsible firepit stand may include different numbers of components than described. For example, the collapsible firepit stand may include three legs, five legs, six legs, etc., may include a single panel that wraps circumferentially around the firepit, or may include three panels, four panels, etc. The collapsible firepit stand may also include a single shelf, or multiple shelves (three shelves, four shelves, etc.), while meeting the general descriptions provided herein. Such variations fall explicitly within the scope of the present disclosure.

Figure 13:
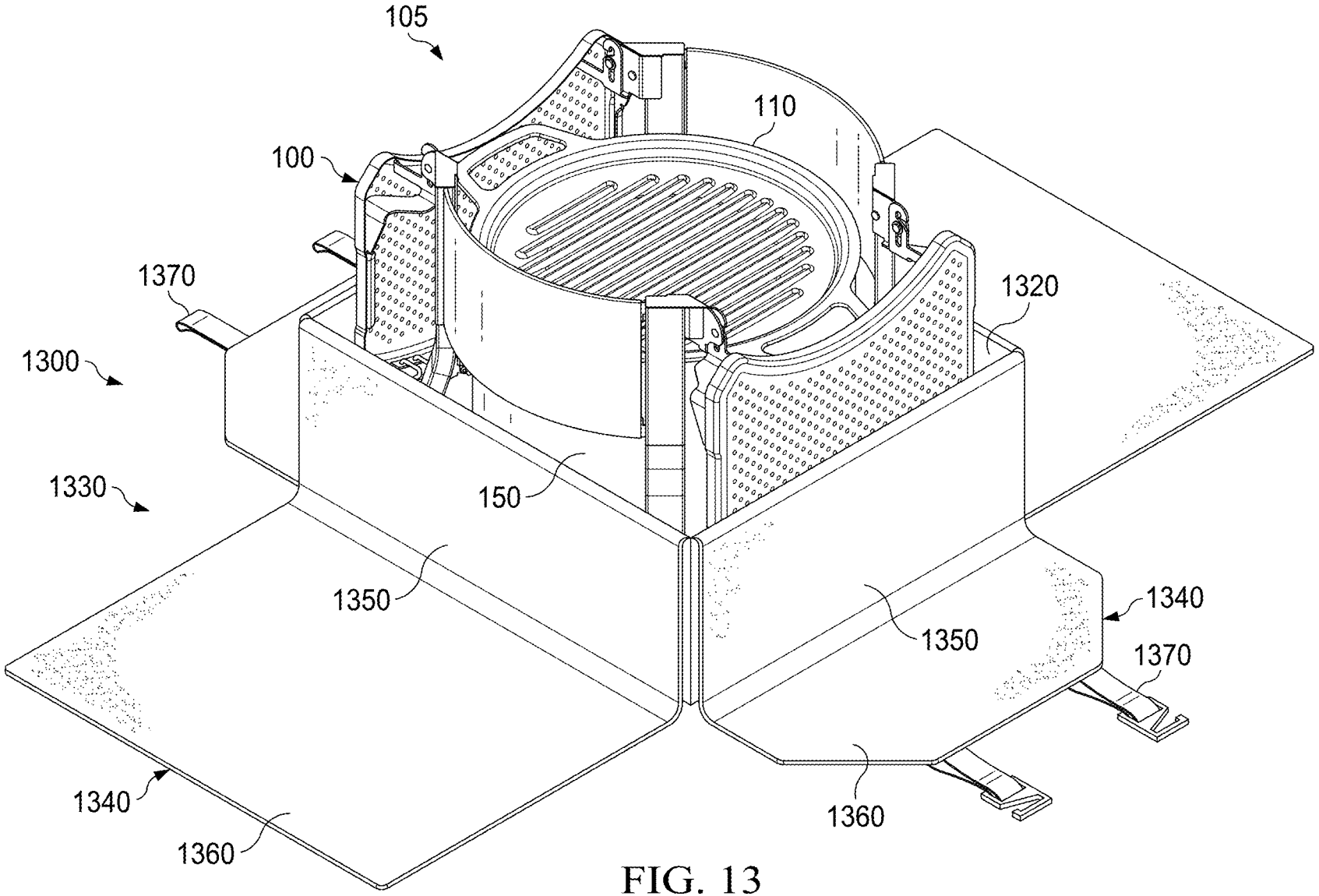
FIG. 13 is a perspective view of an open package containing a firepit system bundle therein, according to an exemplary implementation of the present disclosure.
Figure 14:
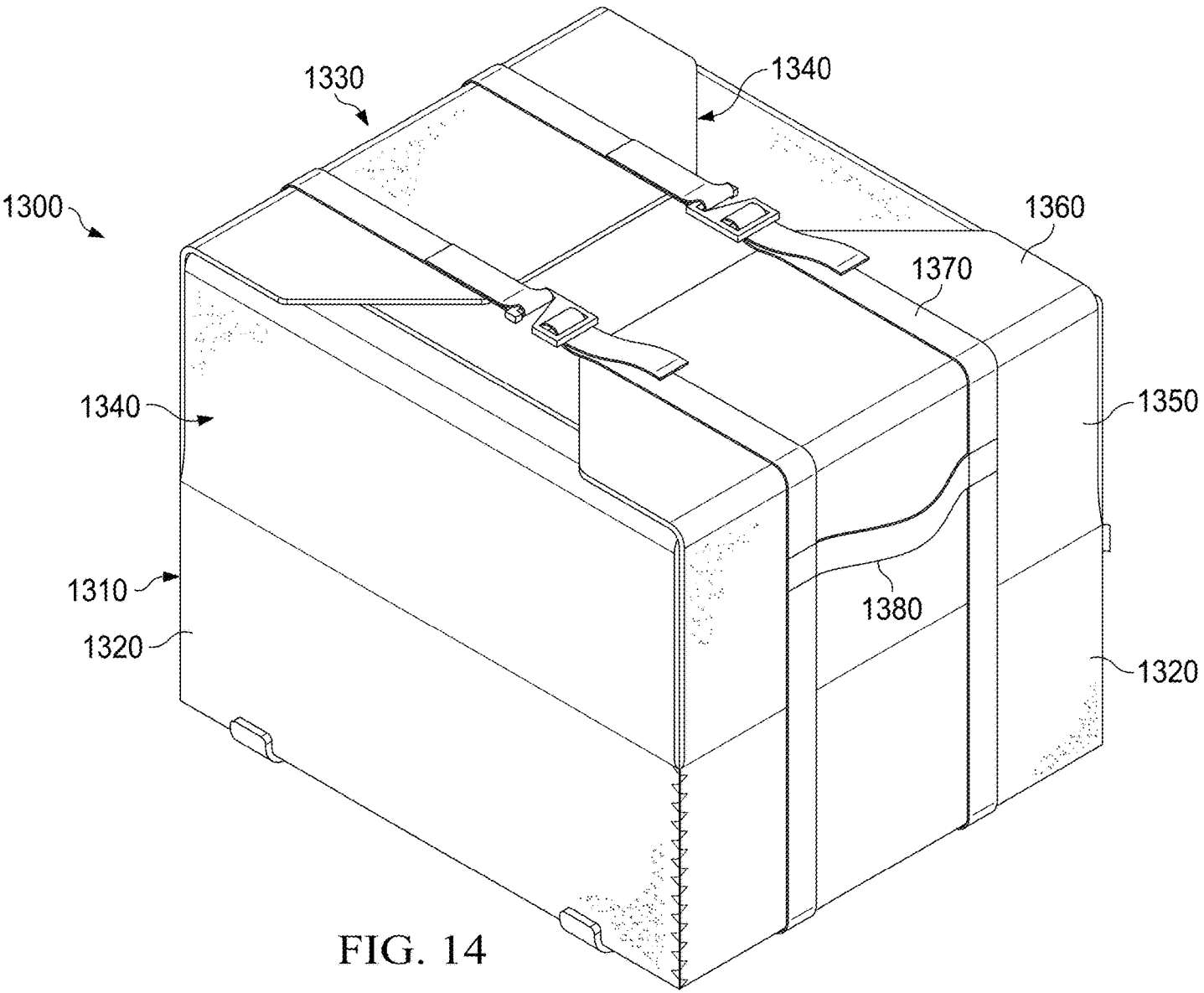
FIG. 14 is a perspective view of a closed package containing a firepit system bundle therein, according to an exemplary implementation of the present disclosure.

FIGS. 13 and 14 show a bundled, small form packaging implementation for the firepit system 105, according to an example implementation. The small form packaging implementation includes a container 1300 for carrying the stand 100, the fire pit 150, the charcoal grate 120 (FIG. 1), and the cooking grill 110. Thus, the firepit system 205 may be compactly bundled in a single container in a manner providing convenience for storage and access when the firepit system 105 is to be shipped, transported, or stored. For example, when the user may wish to use the firepit system for grilling at, for example, a tailgate event or a camping event, the user may carry and transport the stand 100, the fire pit 150, the charcoal grate 120, and the cooking grill 110 in the container 1300. The firepit system 105 may be compacted to its smallest form as shown in FIG. 6. In this configuration, the charcoal adapter 120 (FIG. 1) may be folded and placed inside the fire pit 150, the fire pit 150 may be placed inside the stand 100, and the cooking grill 110 may be placed on the firepit edge. The bundle may then be placed within the container 1300 that compactly carries all the components, as shown in FIG. 13. In this implementation, since the fire pit 120 may slide past the firepit supports 360 to rest inside the firepit receiving area of the stand, and since the grill 110 is sized with handles that are maintained within a boundary of the outer edges of the stand 100, the entire package may be easily stored within a single package.

The container 1300 in this example is a folding box with sides that securely protect the firepit system 105. As can be seen, it includes a base box 1310 formed of sidewalls 1320 shorter than the height of the compressed firepit system 105. The lid 1330 includes top portions 1340 formed of both sidewall pieces 1350 and top covers 1360. Straps 1370 may be used to secure the container 1300 closed, and handles 1380 may be used to simplify carrying.

Figure 15:
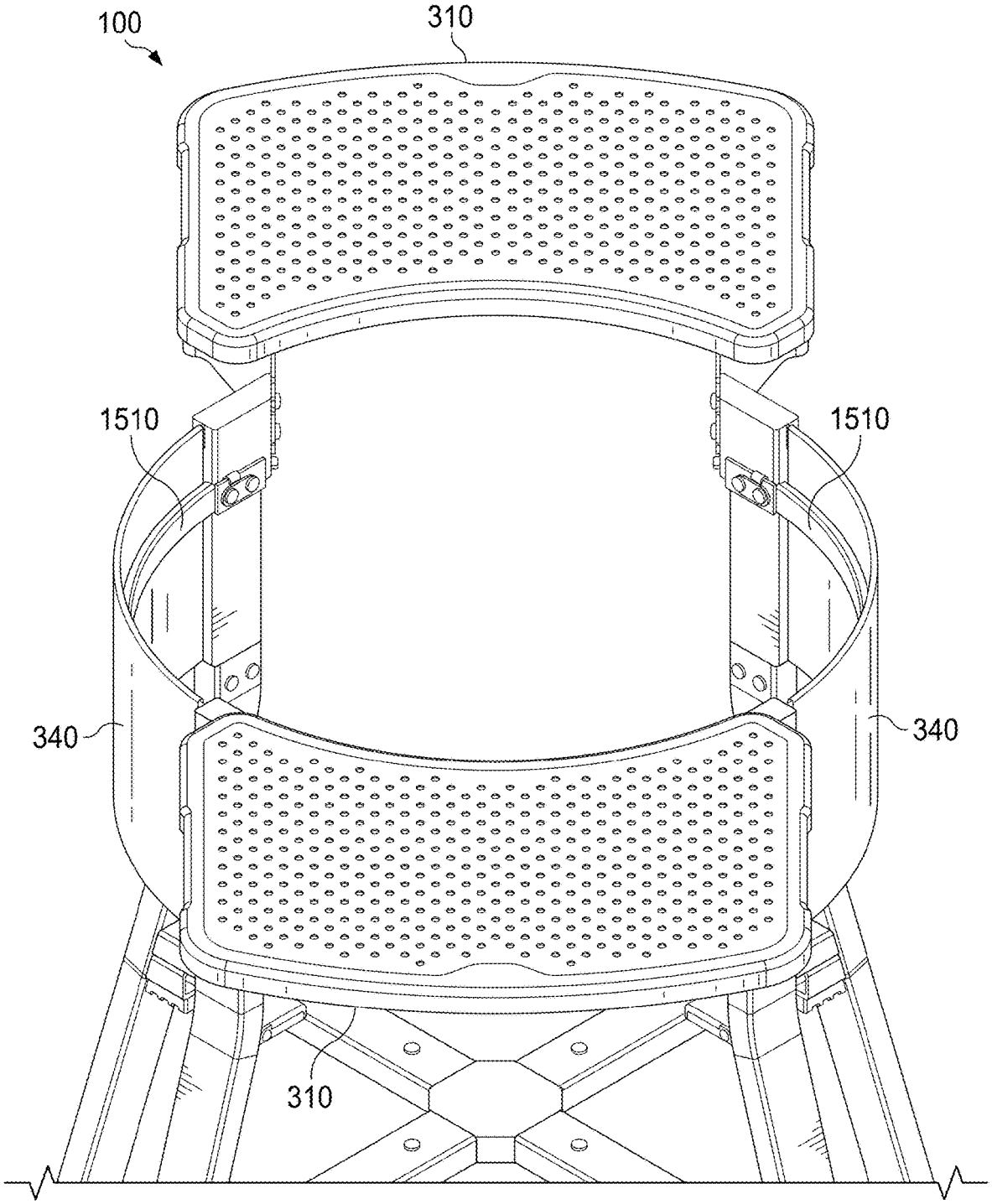
FIG. 15 is a top side perspective view of an example collapsible firepit stand, in accordance with at least one embodiment of the present disclosure.

FIG. 15 is a top side perspective view of an example collapsible firepit stand 100, in accordance with at least one embodiment of the present disclosure. Visible are the foldable shelves 310 and the panels 340. In the example shown in FIG. 15, the panels 340 are heat-resistant fabric panels supported by curved braces 1510 attached to the shelf uprights 350, such that each curved brace 1510 is attached to two shelf uprights 350. FIG. 15 shows one curved brace 1510 per fabric panel 340. However, it is understood that, depending on the implementation, each panel 340 may be supported by two or more curved braces 1510 at different heights. The curved braces may for example be made of a metal such as stainless steel, and may hold the fabric panels 340 in a curved shape as shown. The fabric panels 340 may serve multiple functions, including decoration, branding, protection of the firepit from abrasion and denting, and serving as a heat barrier to reduce the chance of a user accidentally touching the hot outer surface of the firepit.

As will be readily appreciated by those having ordinary skill in the art after becoming familiar with the teachings herein, the collapsible firepit stand allows a firepit to be used at three different stand-off heights that prevent contact between the bottom of the firepit and the surface (lawn, deck, driveway, forest floor, etc.) on which the firepit will be used. Accordingly, it can be seen that the collapsible firepit stand fills a need in the art, by greatly increasing the variety of locations and environments where the firepit can be used.

A number of variations are possible on the examples and embodiments described above. For example, the collapsible firepit stand may be of any size, and designed to work with firepits of any chosen dimensions. The size of the collapsible firepit stand relative to the firepit may be different than shown herein, whole still retaining the general form and function described herein. The collapsible firepit stand may include more than one sed of foldable firepit supports, to allow for positioning of the firepit at different heights. The shelves may be located at different relative heights than shown, may be foldable by a different mechanism than described herein, or may be fixedly attached in the horizontal position. It should further be understood that the described technology may be employed not only for wood-burning firepits, but also charcoal grills, gas grills, camp stoves, and other heat sources.

The logical operations making up the embodiments of the technology described herein are referred to variously as steps, objects, elements, or components. It should be understood that these may occur, or be performed or arranged, in any order, unless explicitly claimed otherwise or a specific order is inherently necessitated by the claim language.

All directional references e.g., upper, lower, inner, outer, upward, downward, left, right, lateral, front, back, top, bottom, above, below, vertical, horizontal, clockwise, counterclockwise, proximal, and distal are only used for identification purposes to aid the reader's understanding of the claimed subject matter, and do not create limitations, particularly as to the position, orientation, or use of the collapsible firepit stand. Connection references, e.g., attached, coupled, connected, joined, or "in communication with" are to be construed broadly and may include intermediate members between a collection of elements and relative movement between elements unless otherwise indicated. As such, connection references do not necessarily imply that two elements are directly connected and in fixed relation to each other. The term "or" shall be interpreted to mean "and/or" rather than "exclusive or." The word "comprising" does not exclude other elements or steps, and the indefinite article "a" or "an" does not exclude a plurality. Unless otherwise noted in the claims, stated values shall be interpreted as illustrative only and shall not be taken to be limiting.

Still other embodiments are contemplated. It is intended that all matter contained in the above description and shown in the accompanying drawings shall be interpreted as illustrative only of particular embodiments and not limiting. Changes in detail or structure may be made without departing from the basic elements of the subject matter as defined in the following claims.

What is claimed is:

1. A stand for a firepit having vertically extending sidewalls and a solid bottom that define a burn chamber, the stand comprising:

a plurality of uprights spaced apart to receive the vertically extending sidewalls of the firepit therebetween;

a horizontal support fixedly attached to the plurality of uprights and configured to be adjacent the firepit when the firepit is received between the plurality of uprights;

a plurality of leg uprights extending from the plurality of uprights;

a plurality of cross members extending from the plurality of leg uprights and toward a central hub; and a plurality of legs selectively connectable to the plurality of leg uprights.

2. The stand of claim 1, comprising a plurality of foldable shelves lockable in a horizontal configuration and selectively transitionable into a vertical configuration.

3. A stand for a firepit, the stand comprising:

a plurality of uprights spaced apart to receive a firepit therebetween;

a horizontal support fixedly attached to the plurality of uprights and configured to be adjacent the firepit when the firepit is received between the plurality of uprights;

a plurality of leg uprights extending from the plurality of uprights;

a plurality of cross members extending from the plurality of leg uprights and toward a central hub;

a plurality of legs selectively connectable to the plurality of leg uprights; and a plurality of foldable firepit supports attached to the plurality of leg uprights above the cross members, and configured to:

allow the firepit to rest on the cross members when oriented in a substantially vertical direction; and allow the firepit to rest on the plurality of foldable firepit supports above the cross members when oriented in a horizontal direction.

4. A stand for a firepit, the stand comprising:

a plurality of uprights spaced apart to receive a firepit therebetween;

a horizontal support fixedly attached to the plurality of uprights and configured to be adjacent the firepit when the firepit is received between the plurality of uprights;

a plurality of leg uprights extending from the plurality of uprights;

a plurality of cross members extending from the plurality of leg uprights and toward a central hub; and a plurality of legs selectively connectable to the plurality of leg uprights, wherein the plurality of legs are removable from the plurality of leg uprights and selectively positionable, via a plurality of cross member feet, in a folded, substantially horizontal position parallel to the plurality of cross members.

5. The stand of claim 4, wherein the plurality of leg uprights are retained against the plurality of cross members via a plurality of retention features fitted into a plurality of grooves within the plurality of cross member feet.

6. The stand of claim 5, wherein the plurality of retention features comprise a plurality of elastic cords.

7. A stand for a firepit, the stand comprising:

a plurality of uprights spaced apart to receive a firepit therebetween;

a horizontal support fixedly attached to the plurality of uprights and configured to be adjacent the firepit when the firepit is received between the plurality of uprights;

a plurality of leg uprights extending from the plurality of uprights;

a plurality of cross members extending from the plurality of leg uprights and toward a central hub;

a plurality of legs selectively connectable to the plurality of leg uprights; and a foldable shelf and a plurality of utensil hooks positioned on the foldable shelf.

8. The stand of claim 7, wherein the stand is positionable on ground, and wherein the shelf is sized such that when the shelf is folded in a vertical position and the plurality of legs are folded in a horizontal position, the shelf and utensil hooks do not touch the ground.

9. A stand for a firepit, the stand comprising:

four shelf uprights;

two foldable shelves, each supported by two of the four shelf uprights;

two curved horizontal supports configured to at least partially surround the firepit, wherein each curved horizontal support is fixedly attached to two of the four shelf uprights;

four leg uprights, wherein each leg upright is fixedly attached to a shelf upright of the four shelf uprights;

a central hub;

four cross members, each fixedly attached to one leg upright of the four leg uprights and to the central hub; and four legs, wherein each leg is selectively connectable to one leg upright of the four leg uprights.

10. The stand of claim 9, wherein each leg is securable in a horizontal configuration and selectively transitionable into a vertical configuration.

11. The stand of claim 9, comprising four foldable firepit supports, each fixedly attached to one leg upright of the four uprights, above the cross members, and configured to:

when oriented in a substantially vertical direction, allow the firepit to rest on the cross members; and when oriented in a horizontal direction, allow the firepit to rest on the foldable firepit supports above the cross members.

12. The stand of claim 9, wherein the legs are removable from the leg uprights and reversibly positionable, via four cross member feet, in a folded, substantially horizontal position parallel to and in contact with the four cross members, wherein each cross member includes one cross member foot of the four cross member feet.

13. The stand of claim 12, wherein the leg uprights are retained against the cross members by nesting features, wherein each nesting feature nests into a groove of a cross member foot.

14. The stand of claim 12, wherein the leg uprights are retained against the cross members via bungie cords, wherein each bungie cord is connected to one leg and one leg upright.

15. The stand of claim 9, wherein each shelf comprises a utensil hook.

16. The stand of claim 15, wherein the stand is positionable on ground, and wherein dimensions of the shelves are such that when the shelves are folded in a vertical position and the legs are folded in a horizontal position, the shelves and utensil hooks do not touch the ground.

17. A firepit stand, comprising:

a plurality of leg uprights;

a plurality of legs movable from a first configuration supporting the leg uprights to a second storage configuration; and a plurality of foldable firepit supports on the leg uprights configured to selectively support a firepit having vertically extending sidewalls and a solid bottom that define a burn chamber.

18. The firepit stand of claim 17, wherein:

when the plurality of foldable legs are in a deployed, substantially vertical position and the plurality of foldable firepit supports are in a deployed, substantially horizontal position, the firepit is supported within the firepit stand at a first height; and when the plurality of foldable legs are in a deployed, substantially vertical position and the plurality of foldable firepit supports are in a folded, substantially vertical position, the firepit is supported within the firepit stand at a second height less than the first height; and when the plurality of foldable legs are in a folded, substantially horizontal position and the plurality of foldable firepit supports are in a folded, substantially vertical position, the firepit is supported within the firepit stand at a third height less than the second height.

19. The firepit stand of claim 18, further comprising a foldable shelf, wherein the foldable shelf is transitionable between a horizontal configuration and a non-horizontal configuration, and wherein the foldable shelf is lockable in the horizontal configuration.

20. The firepit stand of claim 19, further comprising a plurality of feet, wherein at least three feet of the plurality of feet are in contact with ground when the plurality of foldable legs are in a deployed, substantially vertical position, and wherein a different at least three feet of the plurality of feet are in contact with the ground when the plurality of foldable legs are in a folded, substantially horizontal position.

21. A firepit stand, comprising:

a rigid frame comprising:

a plurality of upright legs spaced apart to receive a firepit therebetween, the firepit having vertically extending sidewalls and a solid bottom that define a burn chamber; and a plurality of cross members connecting the plurality of upright legs, the plurality of cross members extending radially inward from the plurality of upright legs to a central hub; and a plurality legs vertically and matingly attachable to the rigid frame in a first standing configuration, and horizontally and matingly attachable to the rigid frame in a second collapsed configuration.

22. The firepit stand of claim 21, further comprising firepit supports supported by the upright legs, the firepit supports being movable between an upward configuration that permits passage of a firepit and a downward configuration that supports the firepit.

23. The firepit stand of claim 22, further comprising a shelf supported by at least two of the plurality of upright legs, the shelf being pivotable between a horizontal position and a vertical position.

24. The firepit stand of claim 21, further comprising:

a curved brace attached to at least two upright legs of the plurality of upright legs; and a fabric panel attached to the curved brace.

* * * * *